US005241937A

United States Patent [19]

Kanehiro et al.

[11] Patent Number: 5,241,937

[45] Date of Patent: Sep. 7, 1993

[54] MISFIRE-DETECTING SYSTEM FOR INTERNAL COMBUSTION ENGINES

[75] Inventors: Masaki Kanehiro; Yuichi Shimasaki; Takuji Ishioka; Shigeki Baba; Takashi Hisaki; Shigeru Maruyama; Masataka Chikamatsu; Shukoh Terata; Kazuhito Kakimoto; Kenichi Maeda; Kazutomo Sawamura; Eitetsu Akiyama, all of Wako, Japan

[73] Assignee: Honda Giken Kogyo Kabushiki Kaisha, Tokyo, Japan

[21] Appl. No.: 986,947

[22] Filed: Dec. 8, 1992

[30] Foreign Application Priority Data

| | | | |
|---|---|---|---|
| Dec. 9, 1991 | [JP] | Japan | 3-350240 |
| Dec. 18, 1991 | [JP] | Japan | 3-353842 |
| Mar. 19, 1992 | [JP] | Japan | 4-093774 |
| Mar. 19, 1992 | [JP] | Japan | 4-093775 |
| Apr. 28, 1992 | [JP] | Japan | 4-136020 |

[51] Int. Cl.[5] ..... F02P 5/14

[52] U.S. Cl. ..... 123/425; 123/419; 123/630

[58] Field of Search ..... 123/425, 419, 417, 406, 123/630; 324/399

[56] References Cited

U.S. PATENT DOCUMENTS

| | | | |
|---|---|---|---|
| 4,558,280 | 12/1985 | Koehl et al. | 123/425 |
| 5,140,962 | 8/1992 | Iwata | 123/425 |
| 5,146,893 | 9/1992 | Osawa | 123/425 |
| 5,180,984 | 1/1993 | Murata et al. | 324/399 |
| 5,188,080 | 2/1993 | Sakakibara et al. | 123/425 |
| 5,190,011 | 3/1993 | Hoshiondo et al. | 123/419 |

FOREIGN PATENT DOCUMENTS

| | | |
|---|---|---|
| 0277468 | 8/1988 | European Pat. Off. . |
| 4-279768 | 10/1992 | Japan . |

*Primary Examiner*—Raymond A. Nelli

*Attorney, Agent, or Firm*—Nikaido, Marmelstein, Murray & Oram

[57] ABSTRACT

A misfire-detecting system detects a misfire occurring in an internal combustion engine. A value of sparking voltage for discharging a spark plug of the engine is detected. The detected value of the sparking voltage is compared with a first predetermined value. A degree to which the detected value of the sparking voltage exceeds the first predetermined value is measured. The measured degree is compared with a second predetermined value. It is determined based upon results of the latter comparison whether or not a misfire occurred in the engine. According to a first aspect of the invention, the second predetermined reference value is set based upon detected values of operating parameters of the engine. According to a second aspect of the invention, the determination of occurrence of a misfire is inhibited when the engine is in a predetermined operating condition.

21 Claims, 32 Drawing Sheets

THREE-WAY CATALYST
14
21
21a
12
$O_2$
13
11
CYL
10
NE
9
TW
15
16
17
INTERNAL COMBUSTION ENGINE
1
FUEL INJECTION VALVE
6
21
21b
8
TA
7
PBA
4
θTH
3
2
5
ECU
INPUT CIRCUIT
C P U
MEMORY MEANS
OUTPUT CIRCUIT
5a
5b
5c
5d
31
32
33
34
35
36
23
22a
22
20
21c

A
t0
V
VCOMP
B'
C'

C
B
t0
t2 t3
t5

D'
D
t1 t2
t4
t5
E'
CP
CPREF

E
t0
t1 t2
t4
t6

1
FMIS
0
t0
t6

T1
T2
A'
t0
t1 t2

TG
G
t3
t4
V
VCOMP

C
0
B
t0
t5 t2 t6 t7 t2 t8
CP
CPREF 0
t3
V
VCOMP

C'
0
B'
t0
t9
t10 t5 t2
t11 t9
t10 t2
t11
CP

CPREF
0
t3
t12

T1
T2
A
t0
t1 t2

TG
G
t3
t4

V
VCOMP
C
0
B
t0
t5 t2 t6 t7 t2 t8

VT
VTREF
0
t3
t4

V
VCOMP
C'
0
B'
t0
t9
t10 t5 t2
t11 t9
t10 t2
t11

VT
VTREF
0
t3
t4 t12
t4

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system of this kind, which is adapted to detect a misfire attributable to the fuel supply system.

2. Prior or Art

An internal combustion engine has spark plugs provided for cylinders for igniting a mixture of fuel and air drawn into the respective cylinders. In general, high voltage (sparking voltage) generated by the ignition coil of the engine is sequentially distributed to the spark plugs of the cylinders of the engine via a distributor, to ignite the air-fuel mixture. If normal ignition does not take place at one or more of the spark plugs, i.e. a misfire occurs, it will result in various inconveniences such as degraded driveability and increased fuel consumption. Furthermore, it can also result in so-called afterburning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called mis-sparking), i.e. normal spark discharge does not take place at the spark plug, due to smoking or wetting of the spark plug with fuel, particularly adhesion of carbon in the fuel to the spark plug, which causes current leakage between the electrodes of the spark plug, or abnormality in the ignition system.

The present assignee has already proposed a misfire-detecting system for detecting misfires attributable to the fuel supply system, which comprises sparking voltage detecting means, and misfire-determining means which determines occurrence of a misfire based on results of comparison between the detected value of the sparking voltage and a predetermined reference value (Japanese Provisional Patent Publication (Kokai) No. 4-279768), and further a misfire-determining system of this kind which comprises sparking voltage-detecting means, and misfire-determining means which determines that a misfire has occurred when a time period over which the detected value of the sparking voltage exceeds a predetermined voltage value or a value proportional to an area of a portion of the detected sparking voltage exceeding the predetermined voltage value exceeds a reference value (U.S. Ser. No. 07/846,238 filed Mar. 5, 1992 based on Japanese Patent Application No. 3-67940).

However, the above proposed system does not specify a manner of setting the predetermined value or the reference value for determining occurrence of a misfire. Therefore, there remains a problem of erroneously determining occurrence of a misfire when the amount of ions generated in the combustion chambers is small even during normal combustion. For example, when the temperature of the combustion chambers is low or the temperature of the air-fuel mixture is low, the amount (density) of ions generated by combustion is small. In such cases, it can not be determined that a misfire has occurred, unless the reference value for determining occurrence of a misfire is set depending on operating conditions of the engine.

Further, when the engine is in particular operating conditions, e.g. when fuel supply to the engine is resumed after fuel cut, or when the engine is being started or has just been started, there is a high possibility that a misfire is erroneously determined to have occurred.

However, the proposed system does not take these problems into consideration.

In the proposed system, misfire detection is carried out even when the engine is in a transient state from air-fuel ratio feedback control based upon an output from an oxygen concentration sensor arranged in the exhaust system of the engine to air-fuel ratio open-loop control, or vice versa (i.e. upon termination of the air-fuel ratio feedback control or upon starting of same). However, in such a transient state, combustion of the mixture becomes unstable, making it difficult to set a suitable reference value for determining a misfire, which results in a high possibility that normal combustion is erroneously determined to be a misfire. However, the above proposed system is intended not to detect a misfire occurring under a temporary or transient engine operating condition in which combustion becomes inevitably unstable, but to detect a constantly-occurring misfire caused by faulty operation of the engine, particularly the fuel supply system. Therefore, even if the system detects a temporary misfire in such a transient state of the engine as described above, it is unable to affirmatively determine that a misfire is occurring.

Further, a similar problem arises when an engine provided with an exhaust gas recirculation system is in a transient state from a state in which the exhaust gas recirculation is being carried out to a state in which it is inhibited or vice versa (i.e. upon termination of the exhaust gas recirculation control or upon starting of same), since the air-fuel ratio of the mixture and the ignition timing undergo temporary changes in this transient state of the engine as well.

If the engine is provided with a valve timing change-over device for changing valving characteristics (hereinafter referred to as "valve timing") of intake valves and/or exhaust valves (timing of opening and closing of the valves, and/or valve lift amount), a similar problem arises when the valve timing is changed, since the amount of fuel supply and a basic ignition timing advance value (which is set according to the engine rotational speed and load on the engine) are changed in response to changing of the valve timing, and hence combustion may become temporarily unstable.

Further, the proposed misfire-detecting system suffers from an inconvenience that if the air-fuel ratio of a mixture supplied to the engine has changed, the reference value for determining occurrence of a misfire can become unsuitable for the determination, to make it impossible to accurately determine occurrence of a misfire.

More specifically, the air-fuel ratio of the mixture is controlled to values suitable for operating conditions of the engine. In other words, generally, the fuel supply control is not carried out with the air-fuel ratio held at a constant or fixed value, but in a normal air-fuel ratio feedback control region, the air-fuel ratio is feedback-controlled to a stoichiometric value (e.g. 14.7) in response to the output from the oxygen concentration sensor, whereas the air-fuel ratio is corrected to a richer value with respect to the stoichiometric value when the temperature of the engine (e.g. the temperature of engine coolant) is low, and to a leaner value with respect to same for the purpose of reducing fuel consumption when the engine is operating in a low load condition. If the air-fuel ratio is varied in this manner, the density of ions generated by combustion of the mixture which determines the reference value also changes, so that the reference value may deviate from a proper value for determining occurrence of a misfire if it is not set with this variation in the air-fuel ratio taken into consideration, and hence an accurate misfire detection becomes impossible to carry out.

Further, in the above proposed system, misfire determination is carried out irrespective of whether there is abnormality in sensors for detecting engine operating parameters, such as the engine rotational speed and the engine load, as well as in wiring connecting the sensors to a control unit. Consequently, there is a possibility that a misfire is erroneously determined to have occurred.

Further, aging or failure of fuel injection valves and a fuel pressure regulator of the engine (the fuel supply system), and the oxygen concentration sensor arranged in the exhaust system can result in inaccurate air-fuel ratio feedback control based upon the output from the oxygen concentration sensor, causing a deviation of the air-fuel ratio from a desired value. In such an event, it is impossible to accurately detect the actual air-fuel ratio determined by the combustion state, and hence to set a proper reference value for determining occurrence of a misfire, which makes it difficult to accurately determine occurrence of a misfire..

SUMMARY OF THE INVENTION

It is a first object of the invention to provide a misfire-detecting system for an internal combustion engine, which is capable of more accurately detecting a misfire attributable to the fuel supply system.

It is a second object of the invention to provide a misfire-detecting system which is capable of accurately determining occurrence of a misfire when the engine is in steady or non-transient operating conditions.

It is a third object of the invention to provide a misfire-detecting system which is capable of setting a reference value used for determination of occurrence of a misfire, in response to variation in the air-fuel ratio of a mixture supplied to the engine, to thereby enhance the accuracy of misfire detection.

To attain the first and third objects, according to a first aspect of the invention, there is provided a misfire-detecting system for detecting a misfire occurring in an internal combustion engine having an ignition system including at least one spark plug, engine operating condition-detecting means for detecting values of operating parameters of the engine, signal-generating means for determining ignition timing of the engine, based upon values of operating parameters of the engine detected by the engine operating condition-detecting means and generating an ignition command signal indicative of the determined ignition timing, and sparking voltage-generating means responsive to the ignition command signal for generating sparking voltage for discharging the at least one spark plug.

The misfire-detecting system includes:

voltage value-detecting means for detecting a value of the sparking voltage generated by the sparking voltage-generating means after generation of the ignition command signal;

first comparing means for comparing the detected value of the sparking voltage with a first predetermined reference value;

measuring means for measuring a degree to which the detected value of the sparking voltage exceeds the first predetermined reference value;

second camparing means for comparing the degree measured by the measuring means with a second predetermined reference value; and misfire-determining means for determining whether or not a misfire has occurred in the engine, based upon results of the comparison by the second comparing means.

The misfire-detecting system according to the first aspect of the invention is characterized by comprising reference value-setting means for setting the second predetermined reference value, based upon detected values of operating parameters of the engine detected by the engine operating condition-detecting means.

Preferably, the degree to which the detected value of the sparking voltage exceeds the first predetermined reference value is a time period over which the detected value of the sparking voltage exceeds the first predetermined reference value.

Alternatively, the degree to which the detected value of the sparking voltage exceeds the first predetermined reference value is an amount by which the detected value of the sparking voltage exceeds the first predetermined reference value.

More preferably, the operating parameters of the engine include a rotational speed of the engine, load on the engine, a temperature of intake air drawn into the engine, a temperature of the engine, an air-fuel ratio of an air-fuel mixture supplied to the engine, an exhaust gas recirculation rate, and humidity of the air, the reference value-setting means setting the second predetermined reference value based upon at least one of the operating parameters of the engine.

Further preferably, the reference value-setting means sets a basic value of the second reference value, based upon the rotational speed of the engine and the load on the engine, and corrects the basic value, based upon at least one of the temperature of intake air, the temperature of the engine, the air-fuel ratio, the exhaust gas recirculation rate, and the humidity of the air, to thereby calculate the second predetermined reference value.

Preferably, the misfire-detecting system includes re-charging means for generating a re-charging command signal at a predetermined time after generation of the ignition command signal, and wherein the sparking voltage-generating means applies voltage having a level low enough not to cause discharging of the spark plug to thereby store an electric charge within the sparking voltage-generating means.

To attain the first and second objects, according to a second aspect of the invention, there is provided a misfire-detecting system for detecting a misfire occurring in an internal combustion engine including at least one spark plug, engine operating condition-detecting means for detecting values of operating parameters of the engine, engine control means for determining a plurality of engine control parameters, based upon values of operating parameters of the engine detected by the engine operating condition-detecting means, for controlling the engine, the engine control means including signal-generating means for determining ignition timing of the engine, based upon values of operating parameters of the engine detected by the engine operating condition-detecting means and generating an ignition command signal indicative of the determined ignition timing, and sparking voltage-generating means responsive to the ignition command signal for generating sparking voltage for discharging the at least one spark plug.

The misfire-detecting system includes:

voltage value-detecting means for detecting a value of the sparking voltage generated by the sparking voltage-generating means after generation of the ignition command signal;

comparing means for comparing the detected value of the sparking voltage with a predetermined reference value; and misfire-determining means for determining whether or not a misfire has occurred in the engine, based upon results of the comparison by the comparing means.

The misfire-detecting system according to the second aspect of the invention is characterized by comprising inhibiting means for inhibiting the determination of occurrence of a misfire by the misfire-determining means, when the engine is in a predetermined operating condition.

Preferably, the misfire-determining means determines that a misfire has occurred when a degree to which the detected value of the sparking voltage exceeds the predetermine reference value exceeds a second predetermined reference value.

Preferably, the misfire-detecting system includes referende value-setting means for setting the predetermined reference value, based upon values of at least part of the operating parameters of the engine.

The operating parameters of the engine include a rotational speed of the engine, load on the engine, a temperature of the engine, a temperature of intake air drawn into the engine, and a voltage of a battery for supplying power to the engine control means. Preferably, the predetermined operating condition of the engine is a condition in which at least one of first, second and third conditions is satisfied, the first condition being satisfied when at least one of the rotational speed of the engine, the load on the engine, the temperature of the engine, the temperature of intake air drawn into the engine, and the voltage of the battery falls outside a respective predetermined range, the second condition being satisfied when excessive slip control of driving wheels of a vehicle on which the engine is installed is being carried out, or when air-fuel ratio leaning control is being carried out, or when fuel supply to the engine is being interrupted, and the third condition being satisfied when a predetermined time period has not elapsed after termination of the interruption of fuel supply to the engine.

Preferably, the engine control means has changeable basic output characteristics for determining the engine control parameters, and the predetermined operating condition of the engine is a condition in which at least one of the basic output characteristics has been changed.

More specifically, the predetermined operating condition of the engine is a condition in which at least one of exhaust gas recirculation control and air-fuel ratio feedback control has been started or terminated.

Also specifically, the predetermined condition of the engine is a condition in which at least one of a valve-operating characteristic of intake valves of the engine and a valve-operating characteristic of exhaust valves of the engine has been changed.

Preferably, the predetermined operating condition of the engine is a condition in which at least one of the operating parameters of the engine and the engine control parameters assumes an abnormal value.

Preferably, the predetermined operating condition of the engine is a condition in which the engine is being started.

Preferably, the predetermined operating condition of the engine is a condition in which a predetermined time period has not elapsed after the engine was started.

Further preferably, the predetermined time period is set depending on the temperature of the engine.

The above and other objects, features, and advantages of the invention will become more apparent from the ensuing detailed description taken in conjunction with the accompanying drawings.

BRIEF DESCRIPTION OF THE DRAWINGS

FIG. 9*a* to FIG. 9*e* form together a timing chart which is useful in explaining the operation of the circuit of FIG. 7 in which:

FIG. 9*a* shows an ignition command signal;

FIG. 9*b* shows the spark voltage and a comparative voltage level VCOMP;

FIG. 9*c* shows an output from a comparator;

FIG. 9*d* shows a count value CP of a counter; and

FIG. 9*e* shows a misfire detection flag FMIS;

FIG. 13*a* to FIG. 13*e* show maps for determining correction coefficients for correcting the basic value CPREF0, in which:

FIG. 13*a* shows a KMTW (engine coolant temperature-dependent correction coefficient) map;

FIG. 13*b* shows a KMTA (intake air temperature-dependent correction coefficient) map;

FIG. 13*c* shows a KMHA (atmospheric humidity-dependent correction coefficient) map;

FIG. 13*d* shows a KMAF (air-fuel ratio-dependent correction coefficient) map; and FIG. 13*e* shows a KMEGR (EGR-dependent correction coefficient) map

FIG. 18*a* to FIG. 18*h* form together a timing chart which is useful in explaining the operation of the FIG. 7 circuit in which:

FIG. 18*a* shows an energization control signal (including an ignition command signal) A;

FIG. 18*b* shows a gate signal G;

FIG. 18*c* shows changes in the sparking voltage and a comparative voltage level VCOMP, occurring at normal firing of a spark plug;

FIG. 18*d* shows changes in an output from a comparator, occurring at in normal firing of the spark plug;

FIG. 18*e* shows changes in the count value CP of the counter at normal firing of the spark plug;

FIG. 18*f* shows changes in the spark voltage and the comparative voltage level VCOMP, occurring at a misfire;

FIG. 18*g* shows changes in the output from the comparator circuit occurring at a misfire; and FIG. 18*h* shows changes in the count value CP of the counter occurring at a misfire;

FIG. 25*a* to FIG. 25*i* form together a timing chart which is useful in explaining the operation of the FIG. 22 circuit in which:

FIG. 25*a* shows an energization control signal (including an ignition command signal) A;

FIG. 25*b* shows a gate signal G;

FIG. 25*c* shows changes in the sparking voltage and a comparative voltage level VCOMP, occurring at normal firing of a spark plug;

FIG. 25*d* shows changes in an output from a first comparator circuit, occurring at normal firing of the spark plug;

FIG. 25*e* shows changes in an output VT from a pulse duration-measuring circuit occurring at normal firing of the spark plug;

FIG. 25*f* shows changes in the sparking voltage and the comparative voltage level VCOMP, occurring at a misfire;

FIG. 25*g* shows changes in the output from the first comparator circuit occurring at a misfire;

FIG. 25*h* shows changes in the output VT from the pulse duration-measuring circuit occurring at a misfire; and FIG. 25*i* shows changes in an output from a second comparator;

DETAILED DESCRIPTION

The invention will now be described in detail with reference to the drawings showing embodiments thereof.

Figure 1:
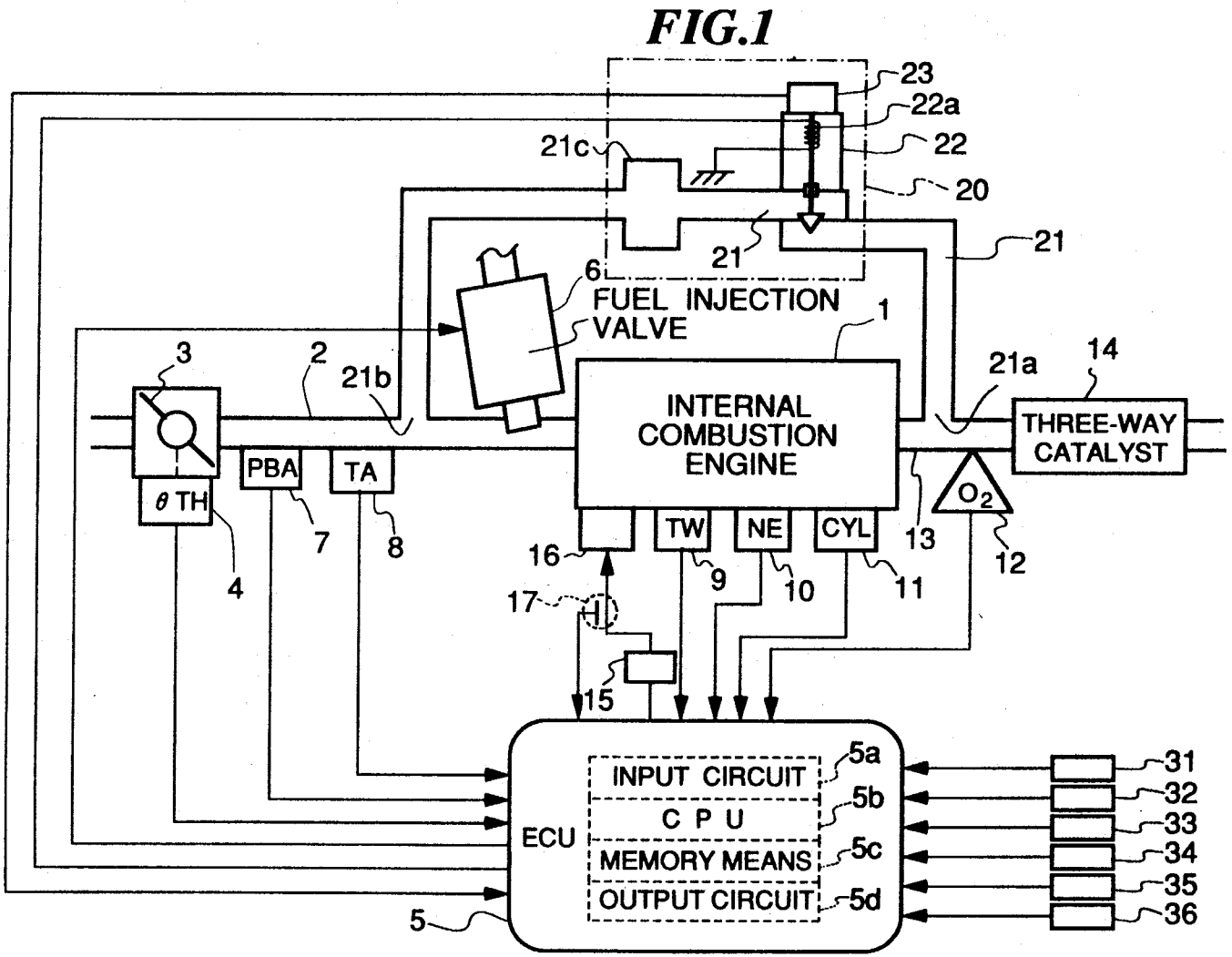
FIG. 1 is a block diagram showing the whole arrangement of an internal combustion engine and a misfire-detecting system therefor, according to a first embodiment of the invention.

Referring first to FIG. 1, there is shown the whole arrangement of an internal combustion engine (hereinafter simply referred to as "the engine") which is a four-cylinder type and provided with an exhaust gas recirculation system, and a control system therefore including a misfire-detecting system according to a first embodiment of the invention. In an intake pipe 2 of the engine 1, there is arranged a throttle valve 3. A throttle valve opening ($\theta$TH)sensor 4 is connected to the throttle valve 3 for generating an electric signal indicative of the sensed throttle valve opening and supplying the same to an electronic control unit (hereinafter referred to as "the ECU") 5.

Fuel injection valves 6 are each provided for each cylinder and arranged in the intake pipe at a location intermediate between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

Each cylinder of the engine is provided with a spark plug 16 which is electrically connected via a distributor 15 to the ECU 5 to have ignition timing $\theta$IG thereof controlled by the ECU 5. Arranged on an intermediate point of a connection line connecting between the distributor 15 and the spark plug 16 is a sparking voltage sensor 17 which is electrostatically coupled to the connection line (i.e. connected to the latter in a manner forming a capacitor of several pF in cooperation with the connection line), for supplying an electric signal indicative of the sensed sparking voltage to the ECU 5.

On the other hand, an intake pipe absolute pressure (PBA) sensor 7 is provided in communication with the interior of the intake pipe 2 via a conduit, not shown, at a location immediately downstream of the throttle valve 3 for supplying an electric signal indicative of the sensed absolute pressure PBA to the ECU 5. An intake air temperature (TA) sensor 8 is inserted into the intake pipe 2 at a location downstream of the intake pipe absolute pressure sensor 7 for supplying an electric signal indicative of the sensed intake air temperature TA to the ECU 5.

An engine coolant temperature (TW) sensor 9, which may be formed of a thermistor or the like, is mounted in the coolant-filled cylinder block of the engine 1 for supplying an electric signal indicative of the sensed engine coolant temperature TW to the ECU 5. An engine rotational speed (NE) sensor 10 and a cylinder-discriminating (CYL) sensor 11 are arranged in facing relation to a camshaft or a crankshaft of the engine 1, neither of which is shown. The engine rotational speed sensor 10 generates a pulse as a TDC signal pulse at each of predetermined crank angles whenever the crankshaft rotates through 180 degrees, while the cylinder-discriminating sensor 11 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and NOx. An oxygen concentration sensor 12 as an exhaust gas ingredient concentration sensor is mounted in the exhaust pipe 13 at a location upstream of the three-way catalyst 14, for supplying an electric signal having a level approximately proportional to the oxygen concentration in the exhaust gases to the ECU 5.

Also connected to the ECU 5 are a battery voltage sensor 31 for detecting a battery voltage VB from a battery, not shown, supplied to the ECU 5, a humidity sensor 32 for detecting the humidity of the air, driving wheel-speed sensors 33, 34 for detecting the rotational speeds WFL, WFR of left and right driving wheels of an automotive vehicle on which the engine is installed, and trailing wheel-speed sensors 35, 36 for detecting the rotational speeds WRL, WRR of left and right trailing wheels of the vehicle, for supplying electric signals indicative of the sensed values to the ECU 5.

Next, the exhaust gas recirculation system 20 will be described.

This system 20 is comprised of an exhaust gas recirculation passage 21 having one end 21*a* thereof opening into the exhaust pipe 13 at a location upstream of the three-way catalyst 14 and the other end 21*b* thereof opening into the intake pipe 2 at a location downstream of the throttle valve 3. An exhaust gas recirculation valve 22 for controlling the flow rate of exhaust gases recirculated and a capacity chamber 21 are interposed in the exhaust gas recirculation passage 21. The exhaust gas recirculation valve 22 is an electromagnetic valve having a solenoid 22*a* which is connected to the ECU 5 to have its opening linearly controlled by a control signal from the ECU 5. The exhaust gas recirculation valve 22 is provided with a lift sensor 23 for detecting the opening of the valve and supplying an electric signal indicative of the sensed opening of same to the ECU 5.

The ECU 5 determines operating conditions of the engine based on signals indicative of operating parameters of the engine supplied from the various sensors, and supplies the control signal to the solenoid 22*a* such that the difference between a command value LCMD of opening of the exhaust gas recirculation valve 22 set according to the intake pipe absolute pressure PBA and the engine rotational speed NE and an actual value of opening of the valve 22 is controlled to zero.

The ECU 5 comprises an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., an output circuit 5*d* which outputs a driving signal to the fuel injection valves 6, etc.

The CPU 5*b* operates in response to the aforementioned signals from the sensors to determine operating conditions in which the engine 1 is operating, such as an air-fuel ratio feedback control region in which the air-fuel ratio is controlled to a stoichiometric value in response to an output from the oxygen concentration sensor 12 and open-loop control regions, and calculates, based upon the determined engine operating conditions, the valve opening period or fuel injection period Tout over which the fuel injection valves 6 are to be opened and ignition timing of the spark plugs 16, in synchronism with inputting of TDC signal pulses to the ECU 5. The CPU 5*b* also carries out a misfire detection or determination based on an output from the sparking voltage sensor 17, as will be described in detail hereinafter.

The CPU 5*b* further controls the opening of the exhaust gas recirculation valve 22 of the EGR system 20 in dependence on operating conditions of the engine, and carries out a traction control based on the driving wheel speeds WFL, WFR and the trailing wheel speeds WRL, WRR. The traction control effects reduction of output torque of the engine by leaning the air-fuel ratio and interrupting fuel supply (fuel cut), for example, when an excessive slip state of the driving wheels is detected.

Further, the CPU 5*b* calculates the ignition timing TIG of the engine, based upon the determined engine operating conditions.

The CPU 5*b* supplies the fuel injection valves 6, the spark plugs 16 and the exhaust recirculation valve 22, respectively, with driving signals based on the results of calculations and determinations carried out as above, through the output circuit 5*d*.

Figure 2:
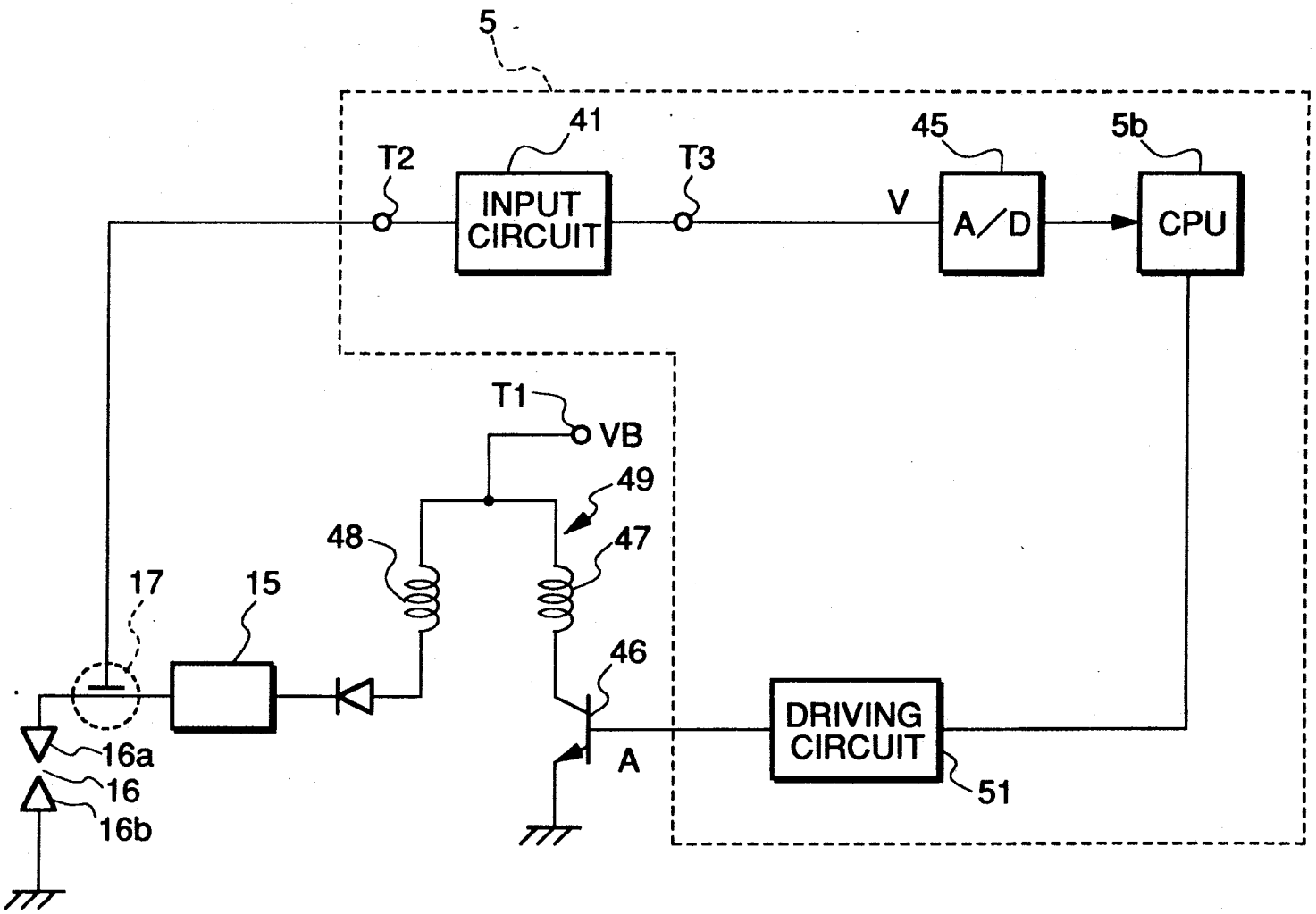
FIG. 2 is a schematic circuit diagram showing the circuit arrangement of the misfiring-detecting system according to the first embodiment.

FIG. 2 shows the circuit arrangement of the misfire-detecting system according to the present embodiment. A feeding terminal T1, which is supplied with supply voltage VB, is connected to an ignition coil 49 comprised of a primary coil 47 and a secondary coil 48. The primary and secondary coils 47, 48 are connected with each other at one ends thereof. The other end of the primary coil 47 is connected to a collector of a transistor 46. The transistor 46 has its base connected via a driving circuit 51 to the CPU 5*b* and its emitter grounded. The base of the transistor 46 is supplied with an ignition command signal A from the CPU 5*b*. The other end of the secondary coil 48 is connected via the distributor 15 to a center electrode 16*a* of the spark plug 16. The spark plug 16 has its grounding electrode grounded.

The sparking voltage sensor 17 is connected via an input circuit 41 to an A/D converter 45 the output of which is connected to the CPU 5*b*. The output voltage (sparking voltage) V from the sensor 17 is inputted to the input circuit 41, converted into a digital value, by the A/D converter 45 and then supplied to the CPU 5*b*.

Figure 3:
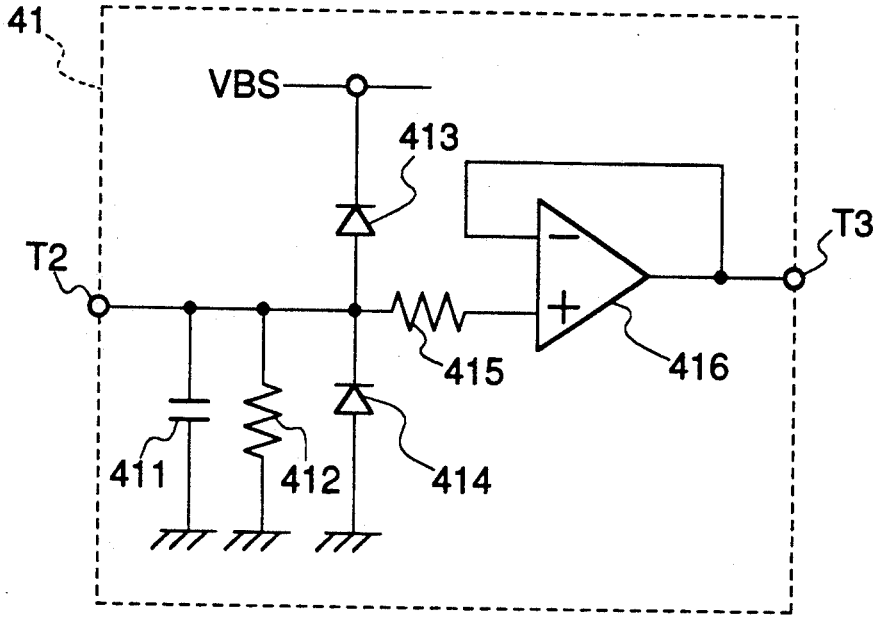
FIG. 3 is a circuit diagram showing details of an input circuit appearing in FIG. 2.

FIG. 3 shows details of the input circuit 41. In the figure, an input terminal T2 is connected to a non-inverting input terminal of an operational amplifier 416 via a resistance 415. The input terminal T2 is also grounded via a circuit formed of a capacitor 411, a resistance 412, and a diode 414, which are connected in parallel, and connected to a supply voltage-feeding line VBS via a diode 413.

The capacitor 411 has a capacitance of $10^4$pF, for example and serves to divide voltage detected by the sparking voltage sensor 17 into one over several thousands. The resistance 412 has a value of 500 KΩ, for example. The diodes 413 and 414 act to control the input voltage to the operational amplifier 416 to a range of 0 to VBS. An inverting input terminal of the operational amplifier 416 is connected to the output of the same so that the operational amplifier 416 operates as a buffer amplifier (impedance converter). The output from the operational amplifier 416 is supplied to the A/D converter 45 as the sparking voltage V.

Figure 4:
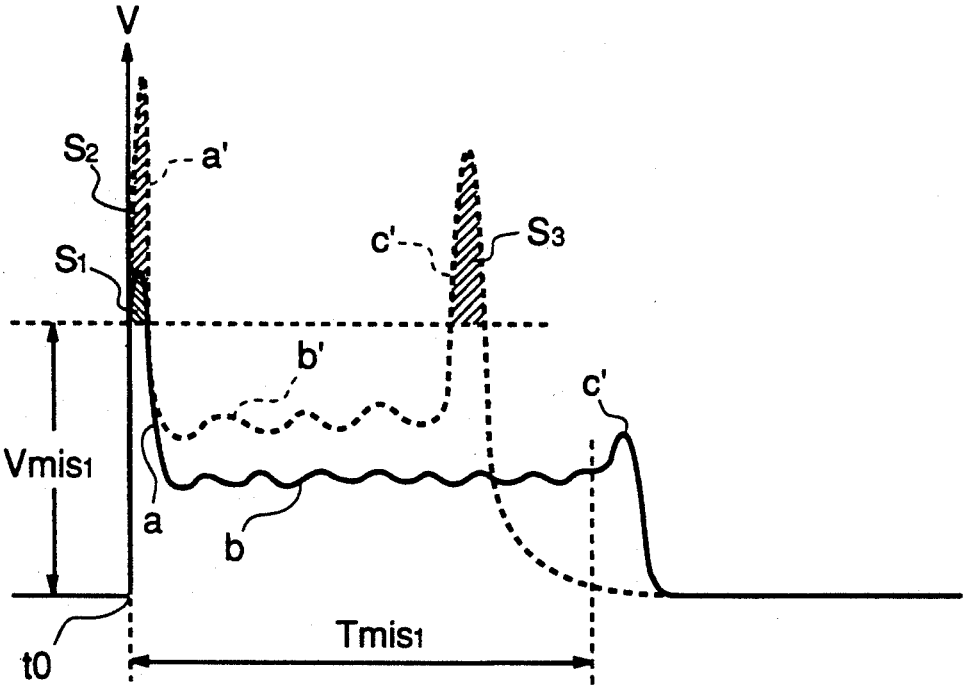
FIG. 4 is a timing chart showing changes in the sparking voltage occurring at normal firing and those occurring at a misfire.

FIG. 4 is a timing chart showing changes in the sparking voltage (primary voltage) with the lapse of time upon occurrence of the ignition command signal, wherein the solid line depicts changes in the sparking voltage, which occur when the air-fuel mixture is normally fired, and the broken line changes in the sparking voltage, which occur when misfire occurs, which is attributable to the fuel supply system (hereinafter referred to as "the FI misfire").

First, a sparking voltage characteristic obtainable in the case of normal firing will be explained, which is indicated by the solid line. Immediately after a time point t0 the ignition command signal A is generated, sparking voltage V rises to such a level as to cause dielectric breakdown of the mixture between the electrodes of the spark plug, i.e. across the discharging gap of the spark plug (curve a). For example, as shown in FIG. 4, when the sparking voltage V has exceeded a reference voltage value Vmis1 for determination of a F1 misfire, i.e. when V>Vmis1, dielectric breakdown of the mixture occurs, and then the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow (curve b). The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge occurs. In this capacitive discharge state, the voltage between the spark plug electrodes again rises, i.e. in the direction of causing dielectric breakdown of the mixture. However, since the ignition coil 49 then has a small amount of residual energy, the amount of rise of the voltage is small (curve c). This is because the electrical resistance of the discharging gap is low due to ionizing of the mixture during firing.

Next, reference is made to a sparking voltage characteristic indicated by the broken line, which is obtained when a FI misfire occurs, i.e. no firing occurs, which is caused by the supply of a lean mixture to the engine or cutting-off of the fuel supply to the engine due to failure of the fuel supply system, etc. Immediately after the time point t0 of generation of the ignition command signal A, the sparking voltage rises above a level causing dielectric breakdown of the mixture. In this case, the ratio of air in the mixture is greater than when the mixture has an air-fuel ratio close to a stoichiometric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture (curve a'), as shown in FIG. 4.

Thereafter, the discharge state shifts to an inductive discharge state, as in the case of normal firing (curve b'). Also, the electrical resistance of the discharging gap of the plug at the discharge of the ignition coil is greater in the case of supply of a lean mixture, etc. than that in the case of normal firing so that the inductive discharge voltage rises to a higher level than at normal firing, resulting in an earlier shifting from the inductive discharge state to a capacitive discharge state (late-stage capacitive discharge). The capacitive discharge voltage upon the transition from the inductive discharge state to the capacitive discharge state is by far higher than that at normal firing (curve c'), because the voltage of dielectric breakdown of the mixture is higher than that at normal firing, and also because the ignition coil still has a considerable amount of residual energy due to the earlier termination of the inductive discharge (i.e. the discharge duration is shorter). Therefore, immediately after this late-stage capacitive discharge, the sparking voltage drastically drops to approx. zero voltage, because the residual energy of the ignition coil drastically decreases.

Figure 5:
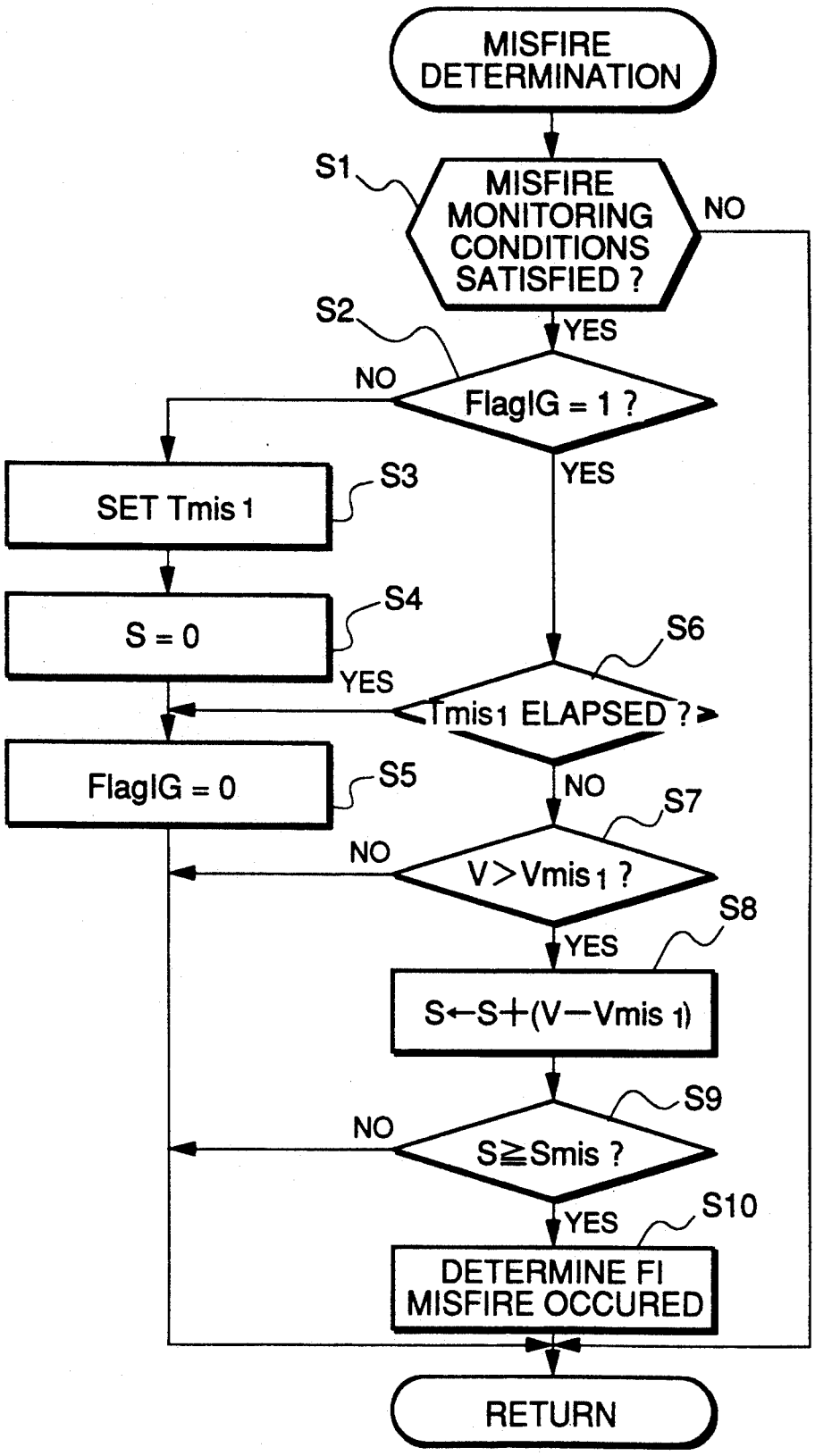
FIG. 5 is a flowchart showing a program for determination of occurrence of a misfire, executed by the misfire-detecting system according to the first embodiment.

FIG. 5 shows a program for determining occurrence of a misfire (misfire determination), which is executed by the CPU 5*b* at predetermined fixed intervals.

First, at a step S1, it is determined whether or not misfire monitoring conditions are satisfied. The misfire monitoring conditions are satisfied when the engine is in operating conditions in which the misfire determination should be executed, which is determined by carrying out a subroutine which will be described hereinafter with reference to FIG. 6. If the misfire monitoring conditions are not satisfied, i.e. if the answer to the question of the step S1 is negative (NO), the program is immediately terminated.

If the answer to the question of the step S1 is affirmative (YES), i.e. if the misfire monitoring conditions are satisfied, it is determined at at a step S2 whether or not a flag IG, which is indicative of whether or not the ignition command signal A has been generated, has been set to a value of 1. The flag IG indicates, when set to 1, that the signal A has been generated. The flag IG is thus set to 1 upon generation of the signal A, and then reset to 0 upon lapse of a predetermined time period. When the ignition command signal A has not been generated, the answer to the question of the step S2 is negative (NO), and then the program proceeds to steps S3, S4 and S5, where a timer within the ECU 5, which measures time elapsed after generation of the ignition command signal A, is set to a predetermined time period Tmis1, and started, a value proportional to an area S, hereinafter referred to, is initialized to zero and stored in the memory means 5c, and the flag IG is set to 0, followed by terminating the program. The value proportional to the area S will be simply referred to as "the value of the area S" hereinafter. The flag IG is set to 1 upon generation of the signal A, by a routine other than the FIG. 5 routine, e.g. an ignition timing-calculating routine.

The predetermined time period Tmis1 is set at a time period slightly longer than a time period from the time of generation of the ignition command signal A to the time of generation of the late-stage capacitive discharge, assumed when a normal firing occurs. The time period Tmis1, as well as predetermined values Vmis1 and Smis, hereinafter referred to, are each read from a map or a table in accordance with operating conditions of the engine 1.

When the ignition command signal A has been generated and hence the flag IG has been set to 1, the program proceeds from the step S2 to a step S6 to determine whether or not the predetermined time period Tmis1, counted by the timer within the ECU 5, has elapsed (see FIG. 4). Immediately after generation of the ignition command signal A, the predetermined time period Tmis1 has not yet elapsed, so that the program proceeds to a step S7 to determine whether or not the sparking voltage V has exceeded the reference voltage value Vmis1 (see FIG. 4). The reference voltage value Vmis1 is set to a value which the sparking voltage V in the case of normal firing necessarily exceeds during the early-stage capacitive discharge. If $V \leqq = Vmis1$, the program is immediately terminated. If $V > Vmis1$, an area is calculated at a step S8, which is defined by the line indicative of the reference voltage value Vmis1 and a portion of the curve indicative of the sparking voltage which is higher than the value Vmis1. The value of this area is added to the value of the area S stored in the memory means 5c to obtain a new value of the area S. Then, it is determined at a step 9 whether or not the new value of the area S exceeds a predetermined value Smis. If the former exceeds the latter, it is determined at a step S10 that an FI misfire has occurred, whereas if the former does not exceed the latter, the program is terminated, determining that no FI misfire has occurred. The above procedure is repeatedly carried out until the predetermined time period Tmis1, counted by the timer, elapses (step S6). The predetermined value Smis is set to a value which is smaller than a value of the area S which can be obtained by addition when an FI misfire occurs.

Values of the area S are exemplified in FIG. 4. In the figure, an area S1 hatched by lines falling rightward shows a value of the area S in the case of a normal firing, while the sum of areas S2 and S3 shows a value of the area S in the case of an FI misfire. The value of the area S in the case of an FI misfire is much larger than that of the area S in the case of a normal firing, so that the former exceeds the predetermined value Smis without fail.

In addition, in FIG. 4, the values of areas S1 and S2 are calculated during the early-stage capacitive discharge, and the area S3 is calculated during the late-stage capacitive discharge. In the program of FIG. 5, the area S means the area S1 alone or the sum of the areas S2 and S3.

Figure 6:
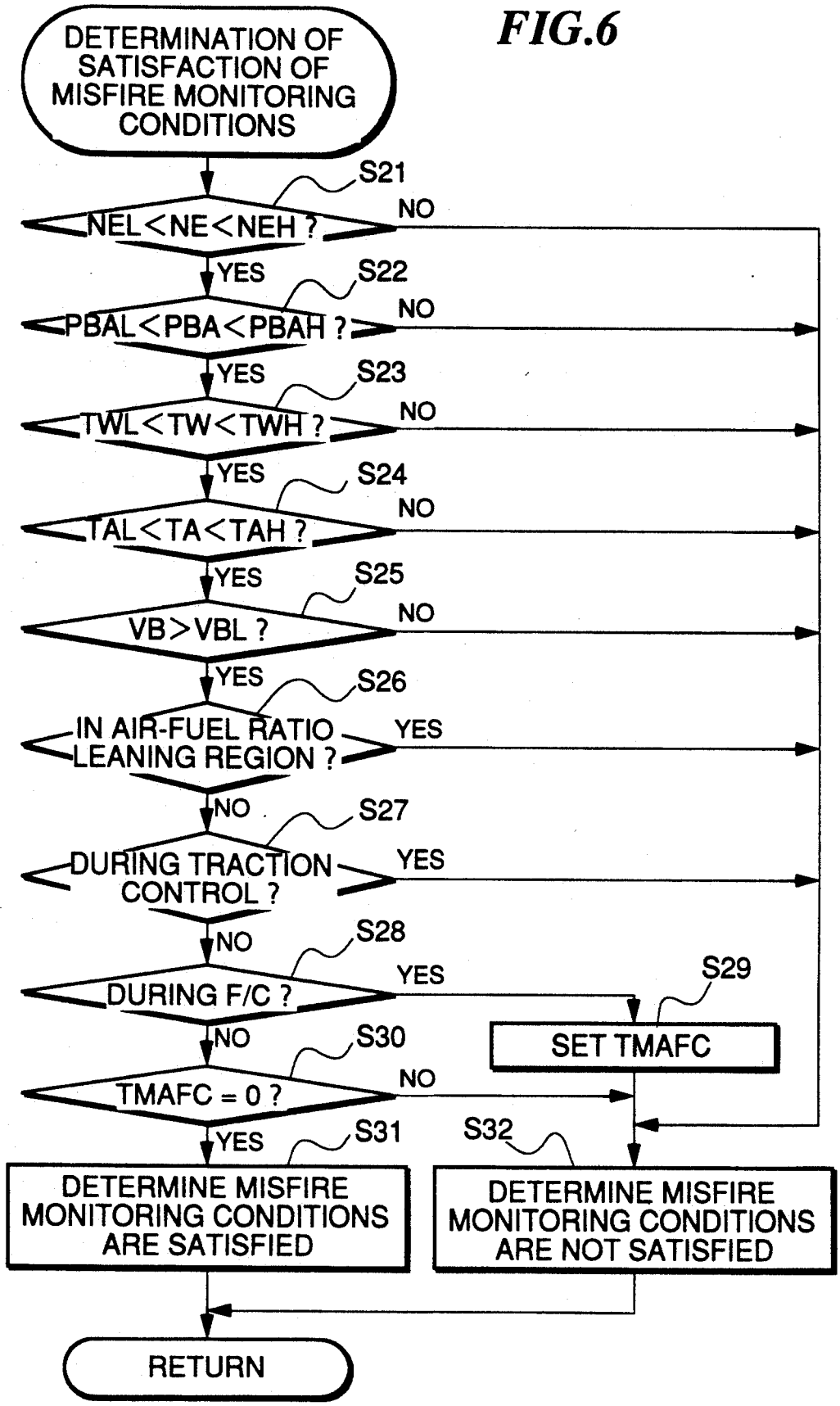
FIG. 6 is a subroutine for determining whether or not misfire-monitoring conditions are satisfied.

FIG. 6 shows a subroutine for determining whether or not the misfire monitoring conditions are satisfied.

At steps S21 to S25, it is determined whether or not parameters indicative of the engine operating condition are within respective predetermined ranges. More specifically, it is determined at a step S21 whether or not the engine rotational speed NE falls within a predetermined range defined by a lower limit value NEL (e.g. 500 rpm) and an upper limit value (e.g. 6,500 rpm), at a step S22 whether or not the intake pipe absolute pressure PBA falls within a predetermined range defined by a lower limit value PBAL (e.g. 260 mmHg) and an upper limit value PBAH (e.g. 760 mmHg), at a step S23 whether or not the engine coolant temperatue TW falls within a predetermined range defined by a lower limit value TWL (e.g. 40° C.) and an upper limit value TWH (e.g. 110° C.). at a step S24 whether or not the intake air temperature TA falls within a predetermined range defined by a lower limit value TAL (e.g. 0° C.) and an upper limit value TAH (e.g. 80° C.), and at a step S25 whether or not the battery voltage VB is higher than a predetermined lower limit value VBL (e.g. 10 V). If any of the answers to these questions is negative (NO), it is determined at a step S32 that the monitoring conditions are not satisfied. These determinations are provided in view of the fact that if the engine is in a normal operating condition, normally the engine rotational speed NE, the intake pipe absolute pressure PBA, the engine coolant temperature TW and the intake air temperature TA fall within the respective predetermined ranges shown above, and that if the battery voltage VB is low, the sparking voltage cannot be high enough to ensure an accurate determination of a misfire.

If all the answers to these questions are affirmative (YES), it is determined at a step S26 whether or not the air-fuel ratio leaning control is being carried out, i.e. the air-fuel ratio is being controlled to a leaner value than the stoichiometric value (which control is carried out e.g. when the engine is decelerating), and it is determined at a step S27 whether or not the traction control is being carried out. If either of the answers to these questions is affirmative (YES), the program proceeds to the step S32 to determine that the monitoring conditions are not satisfied. These steps S26, S27 are provided in view of the fact that the combustion of the air-fuel mixture becomes unstable during air-fuel ratio the leaning control, and the air-fuel ratio leaning control and/or fuel cut is/are carried out during the traction control.

If both the answers to these questions are negative (NO), it is determined at a step S28 whether or not fuel cut is being carried out. If the answer to this question is affirmative (YES), a timer TMAFC is set to a predetermined time period (e.g. 1 second) and started at a step S29, and then the program proceeds to the step S32. If the answer to the question of the step S28 is negative (NO), i.e. if fuel cut is not being carried out, it is determined at a step S30 whether or not the count value of the timer TMFAC is equal to 0. If the answer to this question is negative (NO), i.e. if the predetermined time period has not elapsed after termination of fuel cut, the program proceeds to the step S32, whereas if the answer is affirmative (YES), the program proceeds to a step S31 where it is determined that the monitoring conditions are satisfied. The step S29, S30 are based upon the fact that the combustion of the air-fuel mixture also becomes unstable immediately after the fuel cut.

According to the FIG. 6 program, if any of the aforementioned parameters indicative of the engine operating condition (NE, PBA, TW, TA, VB) is not within the respective predetermined range, if the air-fuel ratio leaning control or the traction control is being carried out, or if fuel cut is being carried out or the predetermined time period has not elapsed after termination of fuel cut, it is determined that the misfire monitoring conditions are not satisfied. Otherwise, it is determined that the monitoring conditions are satisfied.

Therefore, the determination of occurrence of a misfire by the FIG. 5 program is executed only when the combustion of the mixture is stable, which is ensured by satisfaction of the monitoring conditions, to thereby enable accurate determination of occurrence of a misfire.

Figure 7:
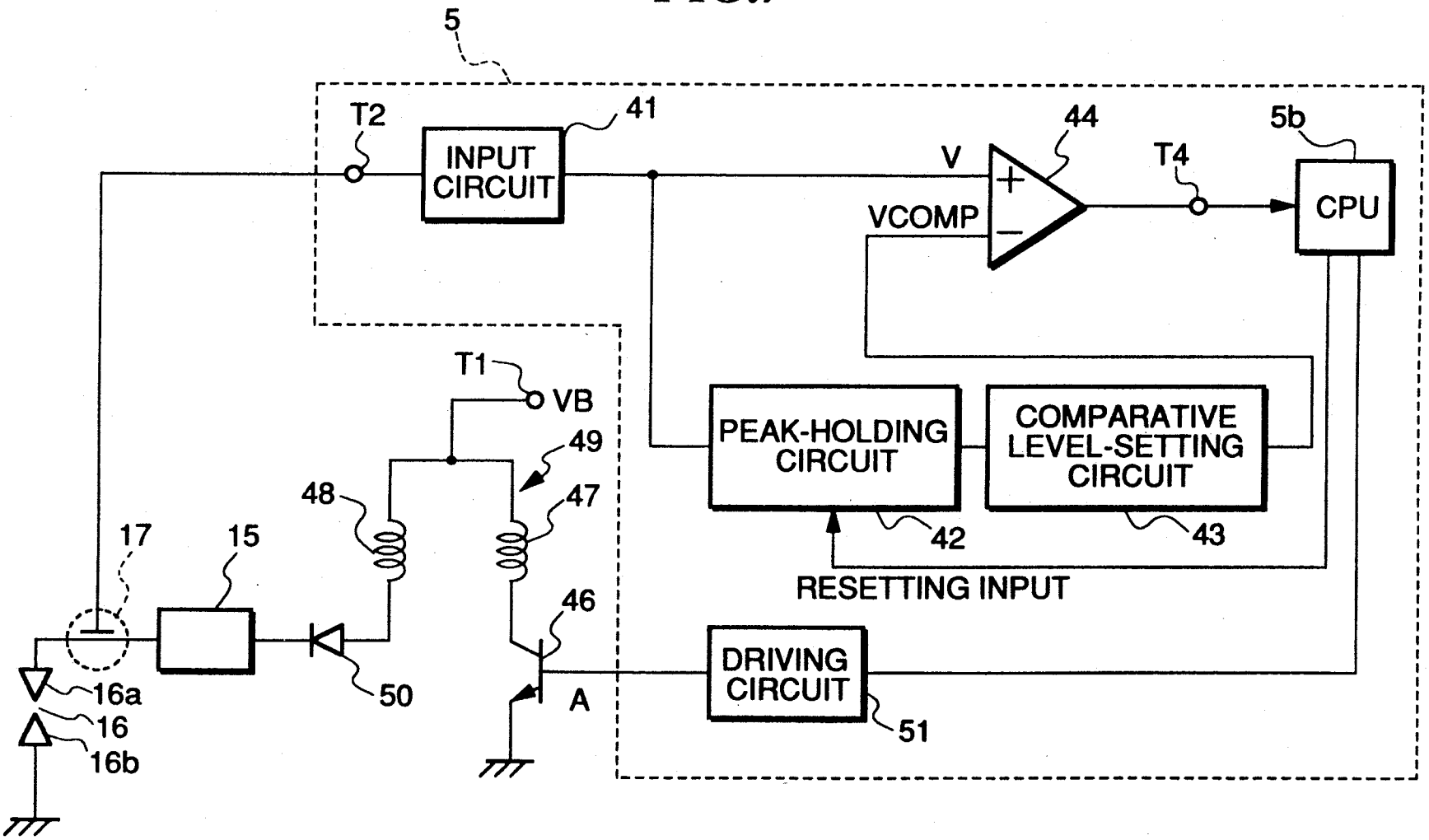
FIG. 7 is a schematic circuit diagram showing the circuit arrangement of a second embodiment of the invention.

FIG. 7 shows the circuit arrangement of a misfire-detecting system according to a second embodiment of the invention. In the figure, elements and parts corresponding to those of the first embodiment shown in FIG. 2 are designated by identical reference numerals. The input circuit 41 is connected to a peak-holding circuit 42 and a non-inverting input terminal of a comparator 44. The output of the peak-holding circuit 42 is connected via a comparative level-setting circuit 43 to an inverting input terminal of the comparator 44. A resetting input terminal of the peak-holding circuit 42 is connected to the CPU 5*b* to be supplied with a resetting signal therefrom at an appropriate time for resetting a peak value of the sparking voltage held by the peak-holding circuit 42. An output from the comparator 44 is supplied to the CPU 5*b*. Further, a diode 50 is connected between the secondary coil 48 of the ignition coil and the distributor 15. Except for those described above, the circuit arrangement of FIG. 7 is identical with that of the first embodiment shown in FIG. 2.

Figure 8:
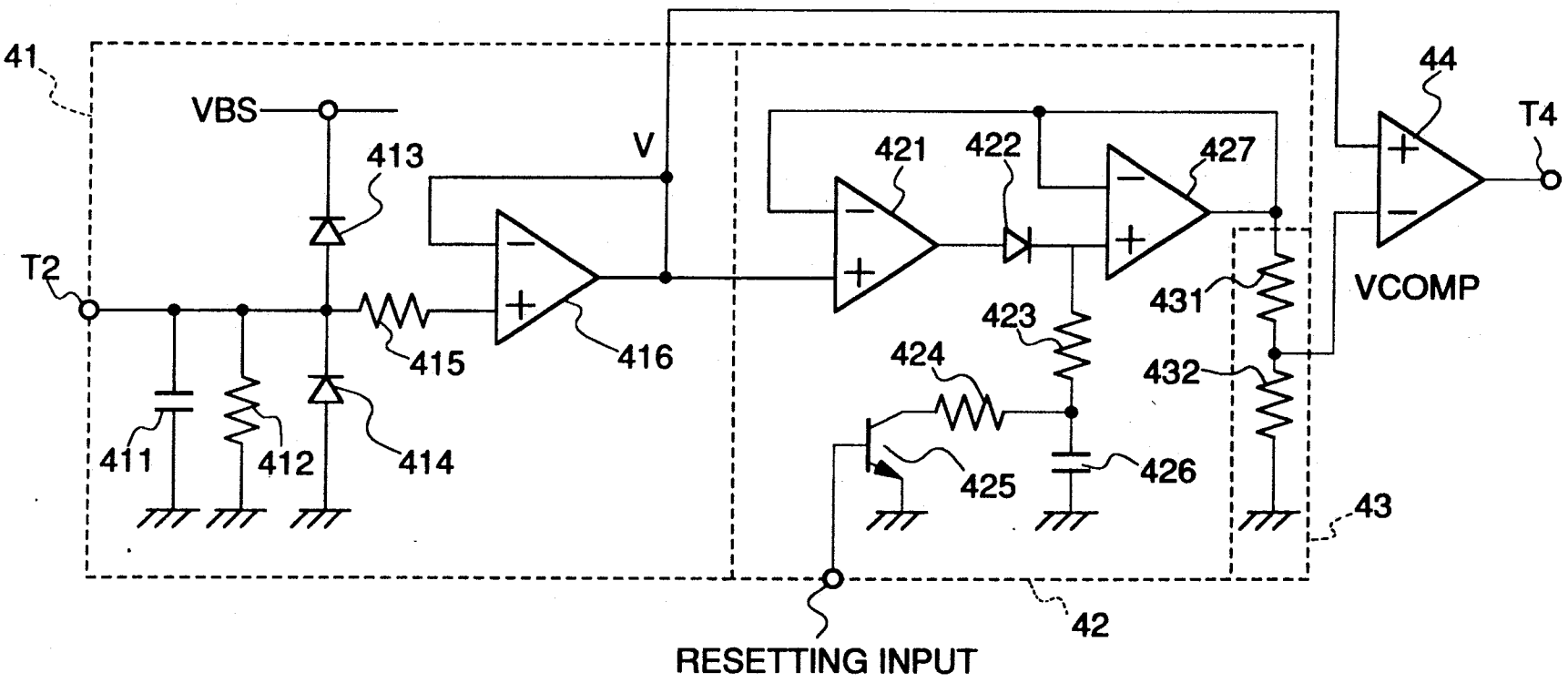
FIG. 8 is a circuit diagram showing details of essential parts of the circuit appearing in FIG. 7.

FIG. 8 shows details of the input circuit 41, the peak-holding circuit 42 and the comparative level-setting circuit 43. The input circuit 41 is identical to that shown in FIG. 3.

In FIG. 8, the output of the amplifier 416 is connected to the non-inverting input terminal of the comparator 44 as well as an inverting input terminal of an operational amplifier 421. The output of the operational amplifier 421 is connected to a non-inverting input terminal of an operational amplifier 427 via a diode 422, with inverting input terminals of the amplifiers 421, 427 both connected to the output of the amplifier 427. Therefore, these operational amplifiers form a buffer amplifier.

The non-inverting input terminal of the operational amplifier 427 is grounded via a resistance 423 and a capacitor 426, the junction therebetween being connected to a collector of a transistor 425 via a resistance 424. The transistor 425 has its emitter grounded and its base supplied with a resetting signal from the CPU 5*b*. The resetting signal goes high when resetting is to be made.

The output of the operational amplifier 427 is grounded via resistances 431 and 432 forming the comparative level-setting circuit 43, the junction between the resistances 431, 432 being connected to the inverting input terminal of the comparator 44.

The circuit of FIG. 8 operates as follows: A peak value of the detected sparking voltage V (output from the operational amplifier 416) is held by the peak-holding circuit 42, the held peak value is multiplied by a predetermined value smaller than 1 by the comparative level-setting circuit 43, and the resulting product is applied to the comparator 44 as the comparative level VCOMP. Thus, a pulse signal indicative of the comparison result, which goes high when V>VCOMP stands, is output from the comparator 44 through a terminal T4.

The operation of the misfire-detecting system constructed as above according to this embodiment will now be explained with reference to a timing chart of FIG. 9*a* to FIG. 9*e*. In FIG. 9*b* to FIG. 9*e*, the solid lines show operation at normal firing, while the broken lines show operation at FI misfire.

Figures 9A, 9B, 9C, 9D, 9E:
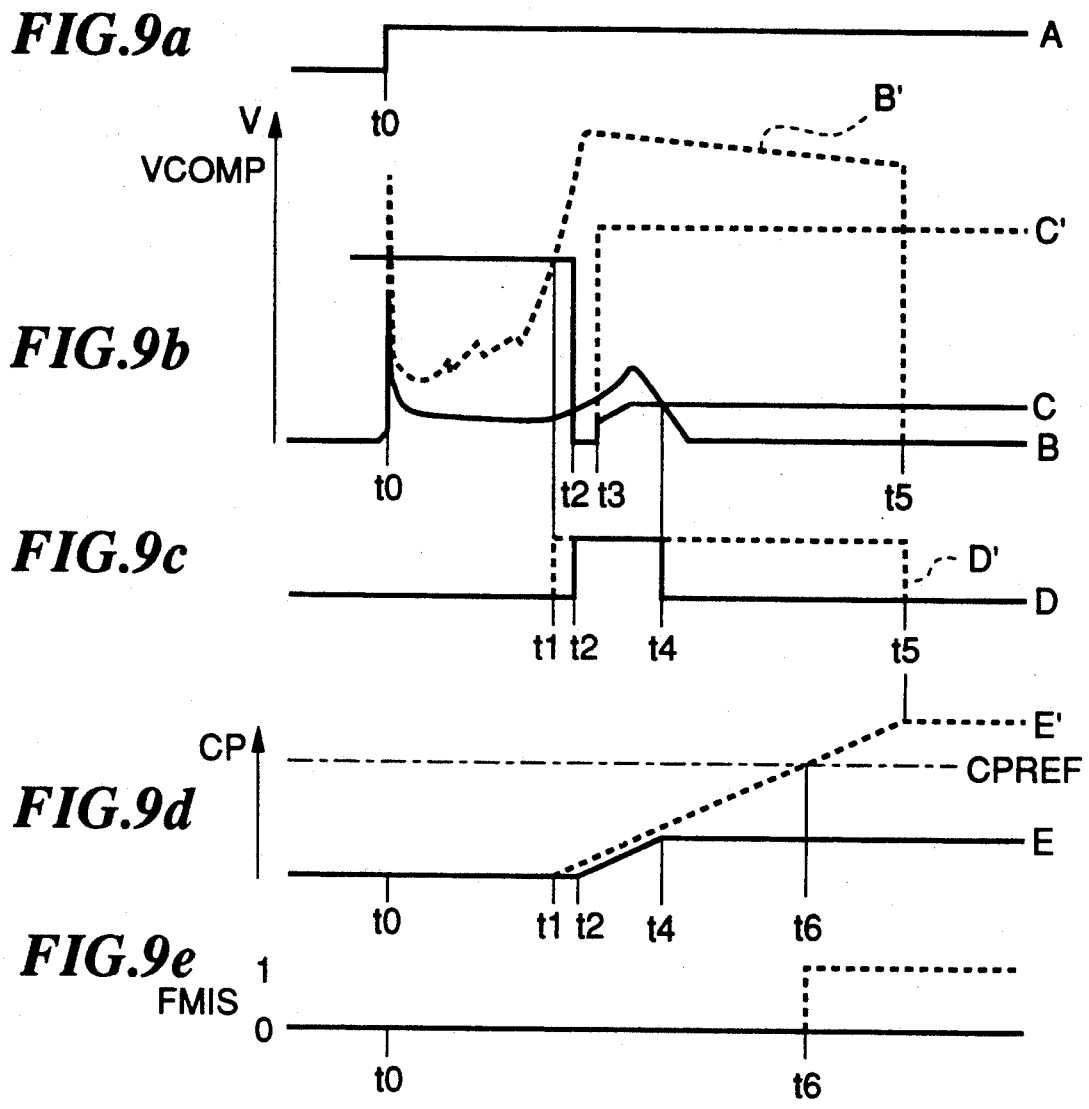

FIG. 9*a* shows an ignition command signal, and FIG. 9*b* show changes in the detected sparking voltage V (B, B') and the comparative level (C, C') with the lapse of time. The curve B at normal firing changes in a similar manner to the curve at normal firing in FIG. 4, referred to hereinbefore. The curve B' at FI misfire shows a different characteristic from that in FIG. 4 in that after the capacitive discharge voltage shows a peak immediately before the termination of the discharge. This is because the diode 50 is provided between the secondary coil 48 and the distributor 15, as shown in FIG. 7. This will be explained in detail below.

Electric energy generated by the ignition coil 49 is supplied to the spark plug 16 via the diode 50 and the distributor 15 to be discharged between the electrodes of the spark plug 16. Residual charge left after the discharge is stored in the floating capacitance between the diode 50 and the spark plug 16. At normal firing, the stored charge is neutralized by ions present in the vicinity of the electrodes of the spark plug 16, so that the sparking voltage V promptly declines after the termination of the capacitive discharge as if the diode 111 were not provided (B in FIG. 9*b*).

On the other hand, when a misfire occurs, almost no ion is present in the vicinity of the electrodes of the spark plug 16 so that the charge stored between the diode 50 and the spark plug 16 is not neutralized, nor is it allowed to flow backward to the ignition coil 49 due to the presence of the diode 50. Therefore, the charge is held as it is without being discharged through the electrodes of the spark plug 16. Then, when the pressure within the engine cylinder lowers so that the voltage between the electrodes of the spark plug 16 required for discharge to occur becomes equal to the voltage applied by the charge, there occurs a discharge between the electrodes (time point t5 in FIG. 9*b*). Thus, by virtue of the action of the diode 111, even after the termination of the capacitive discharge, the sparking voltage V is maintained in a high voltage state over a longer time period than at normal firing.

The curves C, C' in FIG. 9*b* show changes in the comparative level VCOMP with the lapse of time, obtained from the held peak value of the sparking voltage V. The peak-holding circuit 42 is reset during time points t2 and t3. Therefore, the curves before the time point t2 show the comparative level VCOMP obtained from the last cylinder which was subjected to ignition. FIG. 9*c* shows outputs from the comparator 44. As is clear from FIG. 9*b* and FIG. 9*c*, at normal firing, V>VCOMP holds between time points t2 and t4, whereas at misfire, V>VCOMP holds between time points t1 and t5, and during each of the durations, the output from the comparator 44 has a high level.

Therefore, it is possible to determine occurrence of a misfire by measuring the pulse duration of the pulse signal indicative of the comparison result outputted from the comparator 44, and comparing the pulse duration with a reference value.

Figure 10:
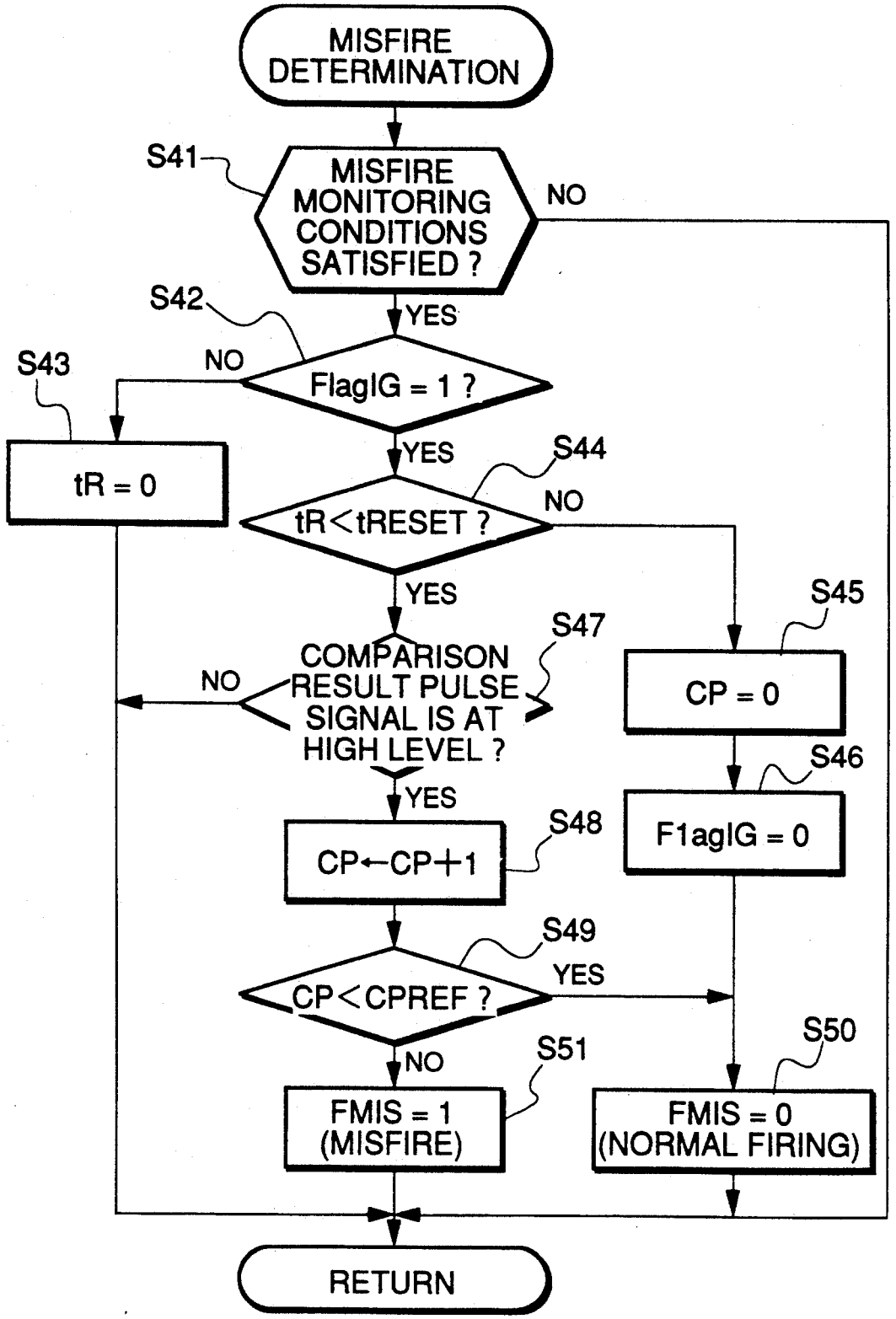
FIG. 10 is a flowchart showing a program for determination of occurrence of a misfire, executed by the second embodiment.

FIG. 10 shows a program for determining occurrence of a misfire based on the pulse signal, which is executed by the CPU 5b at predetermined fixed intervals, or alternatively whenever ignition is effected.

First, at a step S41, it is determined whether or not the aforementioned misfire monitoring conditions are satisfied. If the answer to this question is negative (NO), the program is immediately terminated, whereas if the answer is affirmative (YES), it is determined at a step S42 whether or not the flag IG is equal to 1. If the answer to this question is negative (NO), i.e. if the flag IG is equal to 0, a measured time value tR of a resetting timer is set to 0 at a step S43, followed by terminating the program. If the answer to the question of the step S42 is affirmative (YES), i.e. if the flag IG is equal to 1, it is determined at a step S44 whether or not the value tR of the resetting timer is smaller than a predetermined value tRESET. Immediately after the flag IG has been changed from 0 to 1, the answer to this question is affirmative (YES), and then at a step S47, it is determined whether or not the comparison result pulse signal from the comparator 44 assumes a high level. If the answer to this question is affirmative (YES), a count value CP of a counter is increased by an increment of 1 at a step S48, and then it is determined at a step S49 whether or not the resulting count value CP is smaller than a predetermined value CPREF.

If the answer to the question of the step S49 is affirmative (YES), i.e. if CP<CPREF, it is determined that a normal firing has occurred, and a flag FMIS is set to 0 at a step S50, whereas if the answer is negative (NO), i.e. if CP≧CPREF, it is determined that an FI misfire has occurred, and the flag FMIS is set to 1 at a step S51, followed by terminating the program.

If the answer to the question of the step S44 becomes negative (NO), i.e. tR>tRESET, the count value CP and the flag IG are both reset to 0 at respective steps S45 and S46, followed by the program proceeding to the step S50.

According to the FIG. 10 program described above, as shown in FIG. 9d and FIG. 9e, the count value CP does not exceed the reference value CPREF at a normal firing, whereas the former exceeds the latter at a misfire, e.g. at the time point t6 in the illustrated example, whereupon a misfire is determined to have occurred, and then the flag FMIS is changed from 0 to 1.

Figure 11:
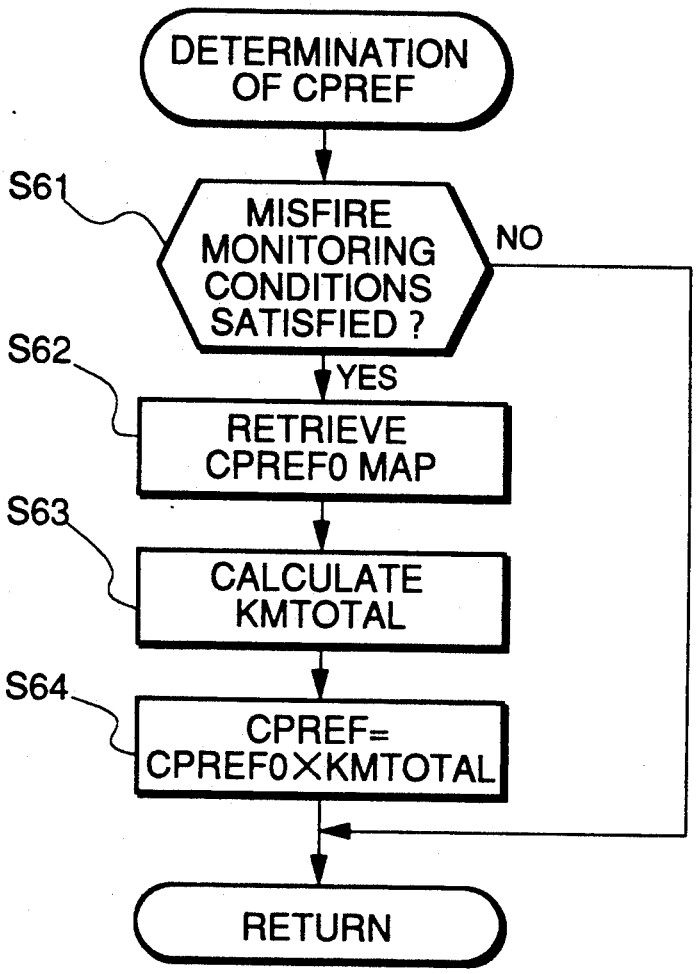
FIG. 11 is a flowchart showing a subroutine for determining a reference value (CPREF)

FIG. 11 shows a subroutine for setting the reference value CPREF, which is executed in synchronism with generation of each TDC signal pulse.

Figure 12A:
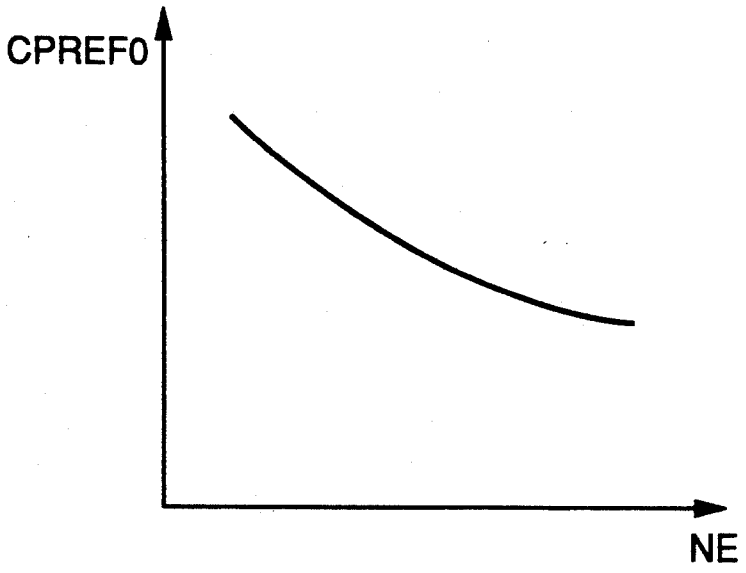
FIG. 12*a* and FIG. 12*b* are diagrams which are useful in explaining how map values are set in a map of a basic value CPREF0 of the reference value CPREF.
Figure 12B:
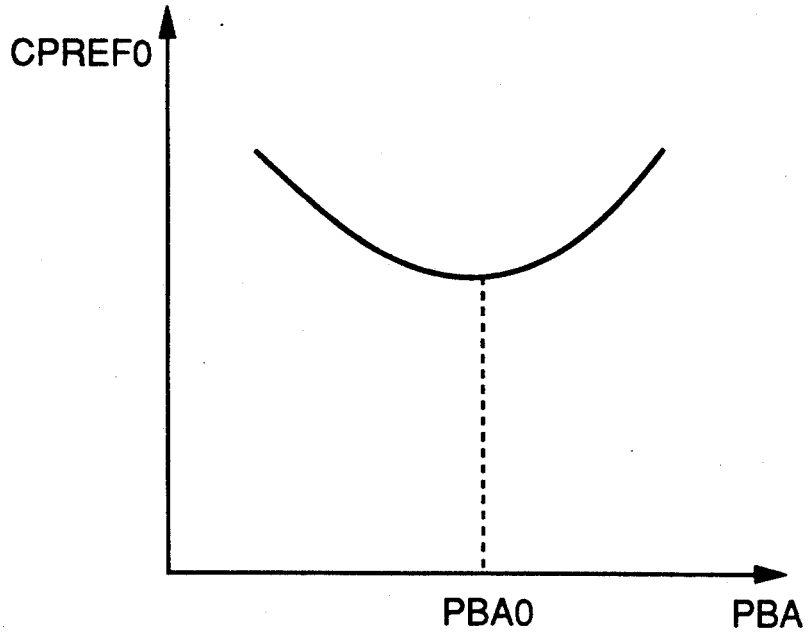

First, at a step S61, it is determined whether on not the misfire monitoring conditions are satisfied. If the answer to this question is negative (NO), the program is immediately terminated, whereas if the answer is affirmative (YES), a CPREF0 map is retrieved to determine a basic value CPREF0 of the reference value CPREF at a step S62. The CPREF0 map is set such that optimum values of the basic value CPREF0 are provided in a manner corresponding to respective predetermined values of the engine rotational speed NE and those of the intake pipe absolute pressure PBA. More specifically, according to the map, the basic value CPREF0 decreases as the engine rotational speed NE increases, as shown in FIG. 12a. This is based upon the fact that the higher the engine rotational speed NE, the shorter the interval of occurrence of pulses of the ignition command signal, so that the pulse duration of the comparison result pulse signal tends to decrease irrespective of a occurrence of misfire as the engine rotational speed NE increases. Further, according to the map, the basic value CPREF0 assumes the minimum value when the intake pipe absolute pressure value PBA assumes a predetermined intermediate value PBA0, as shown in FIG. 12b. This takes into consideration a variation in the pressure within the combustion chamber caused by a variation in the intake pipe absolute pressure PBA, and hence the resulting variation in the required sparking voltage. The optimum basic reference value CPREF0 varies with the type of the engine (air intake characteristics, camming characteristics, etc.) and therefore the map values are set according to the types of individual engines to which the invention is applied.

Figure 13A:
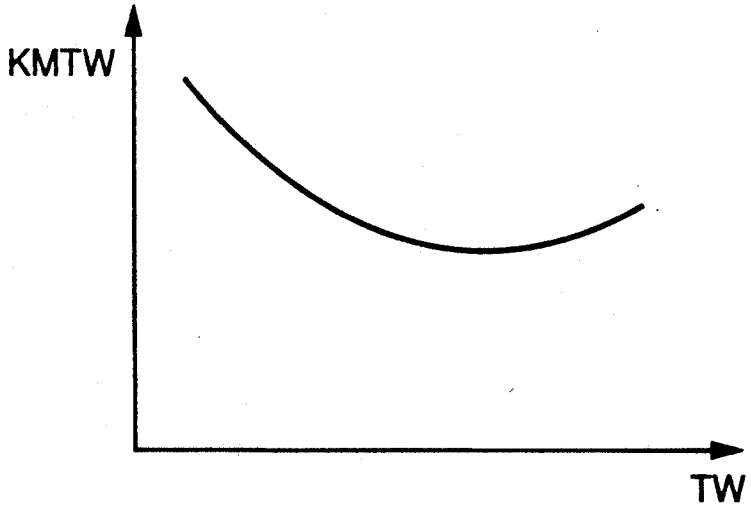

At the following step S63, a correction coefficient KMTOTAL for correcting the basic reference value CPREF0 determined at the step S62 is calculated by the use of the following equation (1):

$$KMTOTAL = KMTW \times KMTA \times KMHA \times KMAF \times KMEGR \quad (1)$$

wherein KMTW represents an engine coolant temperature-dependent correction coefficient which is read from a KMTW table according to the engine coolant temperature detected. The KMTW table is set as shown in FIG. 13a, in view of the fact that the lower the engine temperature, the lower the density of ions generated by combustion within the combustion chamber, and hence the duration of the comparison result pulse tends to increase.

Figure 13B:
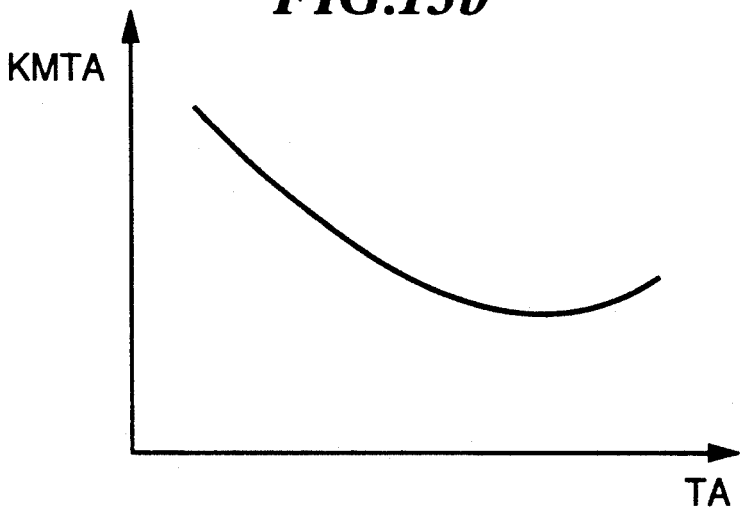

KMTA represents an intake air temperature-dependent correction coefficient which is read from a KMTA table according to the intake air temperature TA detected. The KMTA table is set as shown in FIG. 13b, in view of the tendency that the lower the intake air temperature TA, the lower the density of ions generated by combustion within the combustion chamber.

Figure 13C:
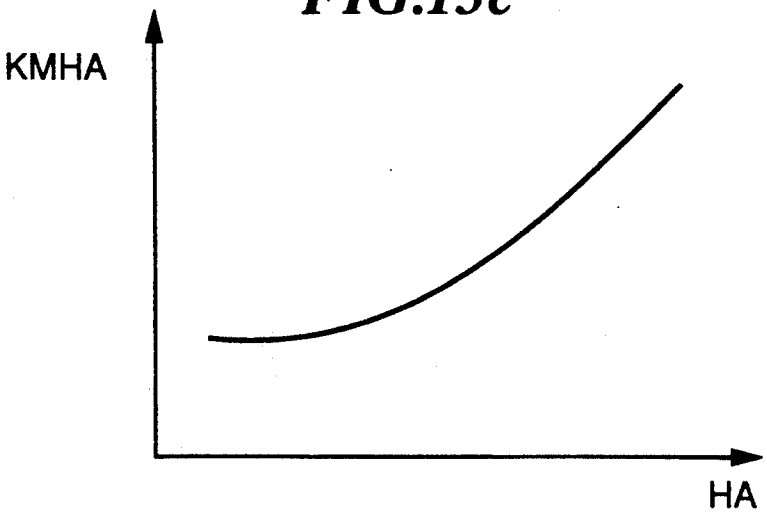

KMHA represents an atmospheric humidity-dependent correction coefficient which is read from a KMHA table according to the atmospheric humidity detected. The KMHA table is set as shown in FIG. 13c in view of the tendency that the higher the atmospheric humidity, the worse the combustion of the air-fuel mixture, and hence the lower the density of ions generated by combustion within the combustion chamber.

Figure 13D:
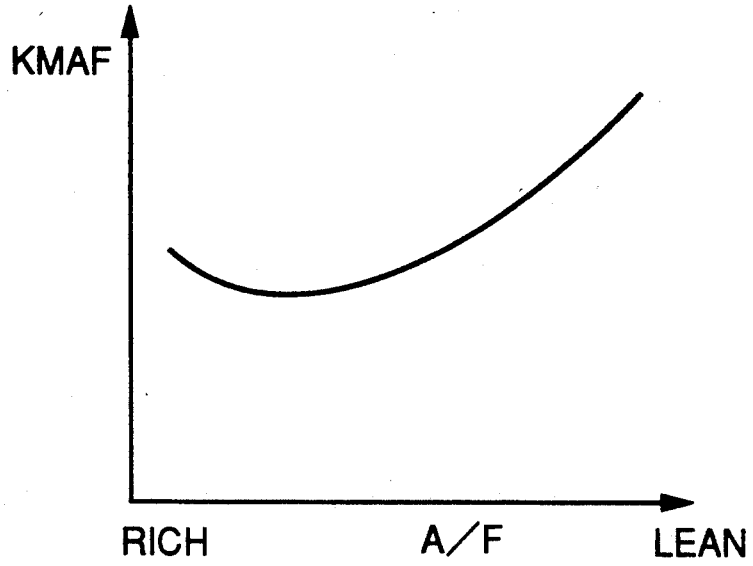

KMAF represents an air-fuel ratio-dependent correction coefficient which is read from a KMAF table according to the air-fuel ratio detected. The KMAF table is set as shown in FIG. 13d in view of the tendency that the more deviated from the stoichiometric value the air-fuel ratio, the worse the combustion of the fuel, and hence the lower the density of ions generated by combustion within the combustion chambers.

Figure 13E:
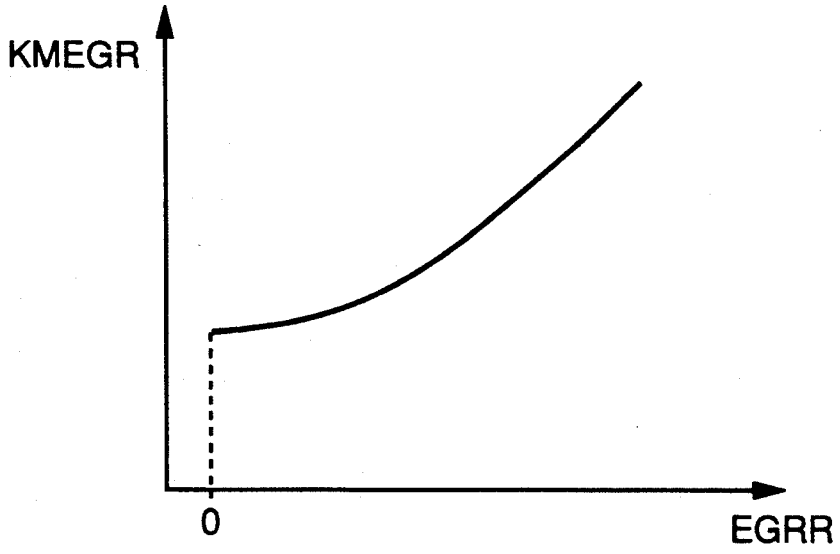

KMEGR represents an EGR-dependent correction coefficient which is read from a KMEGR table according to the exhaust gas recirculation rate (EGR rate) detected. The KMEGR table is set as shown in FIG. 13e in view of the tendency that the higher the EGR rate, the worse the combustion of the fuel. In this connection, the EGR rate EGRR is calculated according to the actual opening LACT of the exhaust gas recirculation valve 22.

Referring again to FIG. 11, at a step S64, the reference value CPREF is calculated by the use of the following equation (2):

$$CREF = CREF0 \times KMTOTAL$$

According to the FIG. 11 program described above, the basic value CPREF0 determined according to the engine rotational speed NE and the intake air temperature PBA is corrected depending on the engine coolant temperature TW, the intake air temperature TA, the atmospheric humidity HA, the air-fuel ratio A/F and the EGR rate EGRR to obtain the reference value CPREF. The reference value CPREF thus calculated is applied to the FIG. 10 program to carry out misfire determination, which enables an accurate determination of occurrence of a misfire irrespective of changes in the engine operating condition.

The peak-holding circuit 22 in FIG. 7 may be replaced by an averaging circuit (integrating circuit).

In the second embodiment described above, a valve proportional to an area defined by the line indicative of the comparative level VCOMP and a portion of the curve indicative of the detected sparking voltage V which is higher than the comparative level VCOMP (i.e. a value obtained by integrating (V-VCOMP)) may be calculated to detect a misfire in a manner similar to the first embodiment. Further, the first embodiment may be coupled to the second embodiment so as to determine occurrence of a misfire only when the results obtained by the two embodiments both indicate occurrence of a misfire.

Further, in determining occurrence of a misfire based on the above-mentioned area-proportional value, it is preferable that a reference value for the misfire determination (Smiss in the first embodiment) should be set in dependence on operating conditions of the engine, similarly to the reference value CPREF.

Further, measurement of duration of the comparison result pulse signal in the second embodiment may be carried out only during a gate controlled time period (e.g. over a latter half part of the discharge duration).

Figure 14:
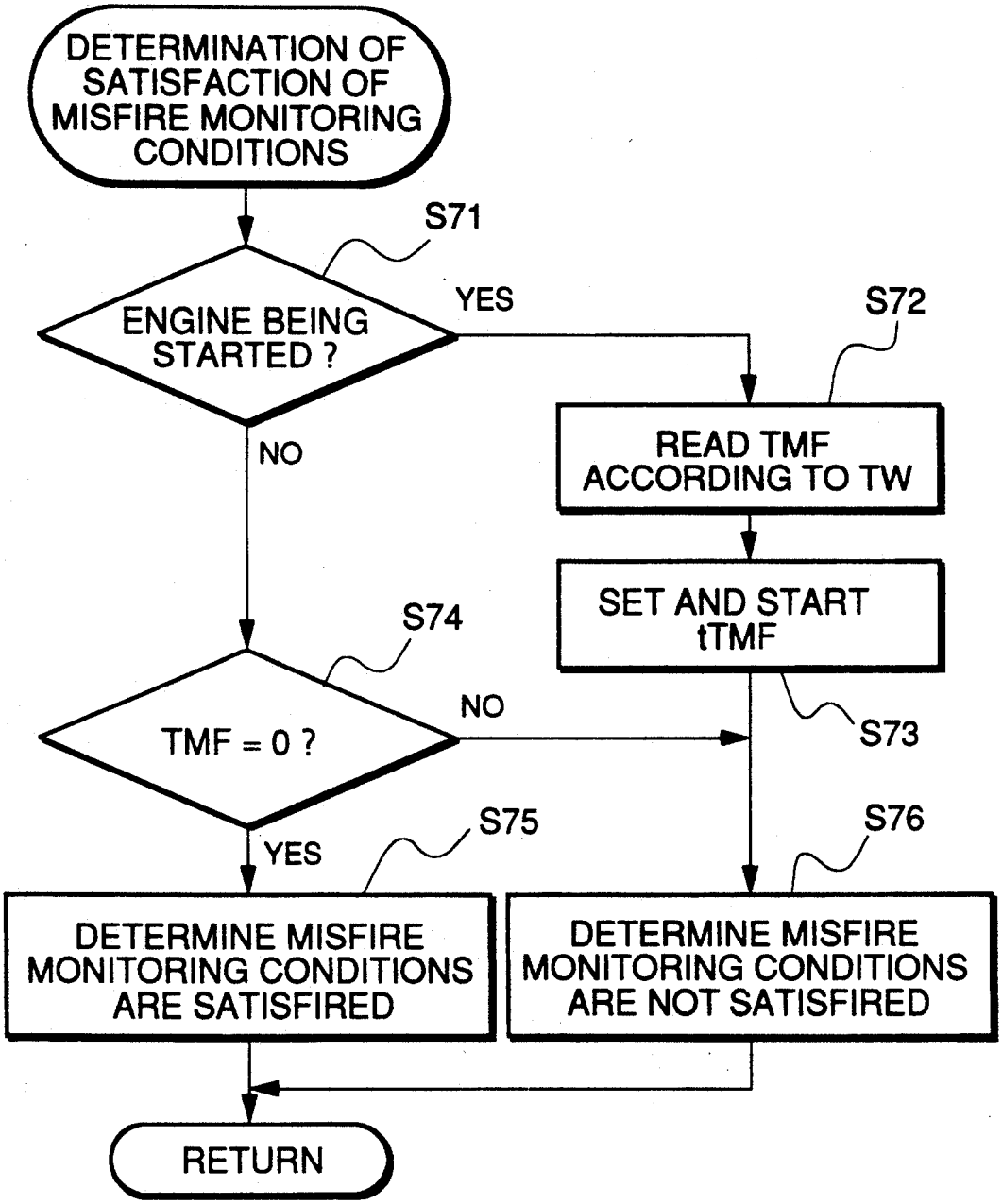
FIG. 14 is a subroutine for determining whether or not misfire-monitoring conditions are satisfied, which is executed by a third embodiment and a fourth embodiment of the invention.
Figure 15:
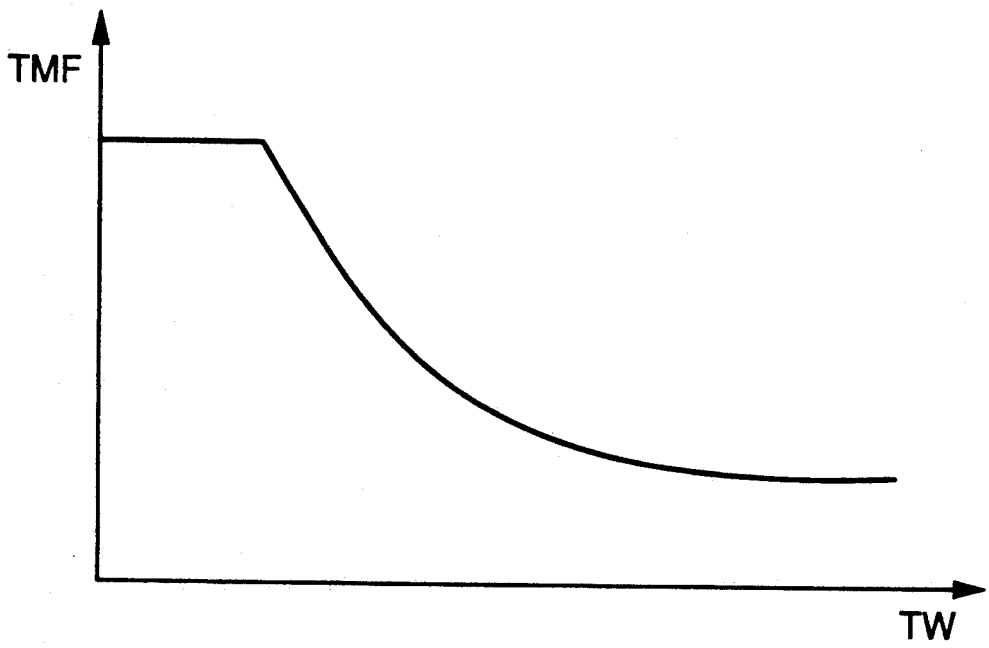
FIG. 15 shows a TMF map for determining a time period over which monitoring of operation of spark plugs is to be inhibited.

Next, reference is made to FIG. 14 and FIG. 15 showing third and fourth embodiment of the invention. These embodiments are distinguished from the first and second embodiments described above, respectively, in the misfire monitoring conditions. More specifically, the third and fourth embodiments employ a subroutine shown in FIG. 14, described in detail below, instead of the FIG. 6 subroutine, to carry out a determination as to whether the monitoring conditions are satisfied, which determination is made at the step S1 in the FIG. 5 program, and at the step S41 in the FIG. 10 program, respectively. Except for the misfire monitoring conditions, the third and fourth embodiments are identical with the first and second embodiments respectively.

Referring to FIG. 14, it is determined at a step S71 whether or not the engine is being started. This determination is made, e.g. by determining whether or not the starter switch has been closed, and whether or not the engine rotational speed NE is higher than a predetermined value. If the answer to this question is affirmative (YES), i.e. if the engine is being started, a monitoring-inhibiting time period TMF is determined by retrieving a TMF table according to the engine coolant temperature TW detected, at a step S72. The TMF table is set, e.g. as shown in FIG. 15, such that optimum values of the monitoring-inhibiting time period are set in relation to the engine coolant temperature TW in such a manner that the monitoring-inhibiting time period TMF decreases as the engine coolant temperature TW increases.

At the following step S73, a timer tTMF is set to the monitoring-inbiting time period TMF determined at the step S72 and started, and then it is determined at a step S76 that the misfire monitoring conditions are not satisfied, followed by terminating the subroutine.

If the answer to the question of the step S71 is negative (NO), i.e. if the engine is not being started, it is judged that the engine is in self-sustaining operation after the start, and then it is determined at a step S74 whether or not the count value of the timer tTMF is equal to 0. If the answer to this question is negative (NO), i.e. if the monitoring-inhibiting time period has not elapsed after the engine was started, it is determined at a step S76 that the monitoring conditions are not satisfied, whereas if the answer is affirmative (YES), it is determined at a step S75 that the monitoring conditions are satisfied, followed by terminating the subroutine.

According to this program, while the engine is being started and before the monitoring-inhibiting time period TMF elapses after the engine was started, it is determined that the monitoring conditions are not satisfied. This is because of the fact that while the engine is being started and before the monitoring-inhibiting time period TMF elapses after the engine was started, the combustion is unstable and hence it is impossible to effect an accurate determination of occurrence of a misfire. Further, the reason for setting the monitor-inhibiting time period TMF to a shorter value as the engine coolant temperature TW is higher, is that the higher the engine coolant temperature TW, the sooner the combustion becomes stable. This subroutine particularly takes into consideration the fact that usually, the engine temperature is low at the start of the engine, but in the case where the engine is restarted shortly after stoppage, the engine temperature varies depending upon the operating condition of the engine assumed just before stoppage as well as the duration of stoppage. Further, if the engine temperature at the start of the engine is as high as a value assumed when the engine has been warmed up, the monitoring-inhibiting time period TMF may be set to 0 to thereby inhibit monitoring only during the start of the engine.

According to the third and fourth embodiments described above, by determining whether or not the misfire monitoring conditions are satisfied, by the use of the FIG. 14 subroutine, the misfire determination is carried out only when the monitoring conditions are satisfied, that is only when the combustion of fuel is stable, to thereby make it possible to determine occurrence of a misfire more accurately.

In addition, although in the third and fourth embodiments, the engine coolant temperature TW is used as a parameter representative of the engine temperature, this is not limitative, but another temperature such as the temperature of lubricating oil may be used instead.

Figure 16:
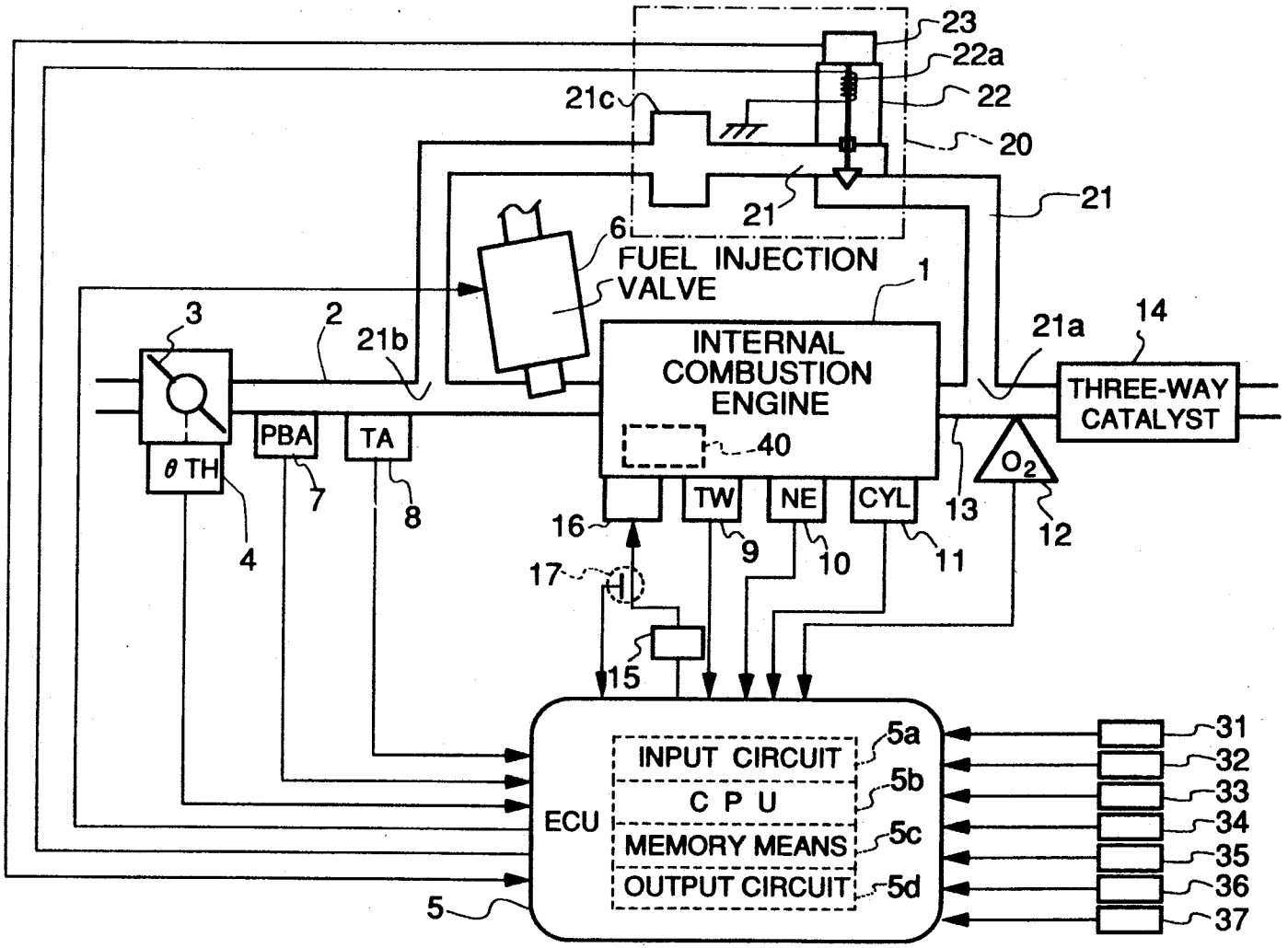
FIG. 16 is a block diagram showing the whole arrangement of an internal combustion engine, and a misfire-detecting system therefor, according to a fifth embodiment of the invention.
Figure 17:
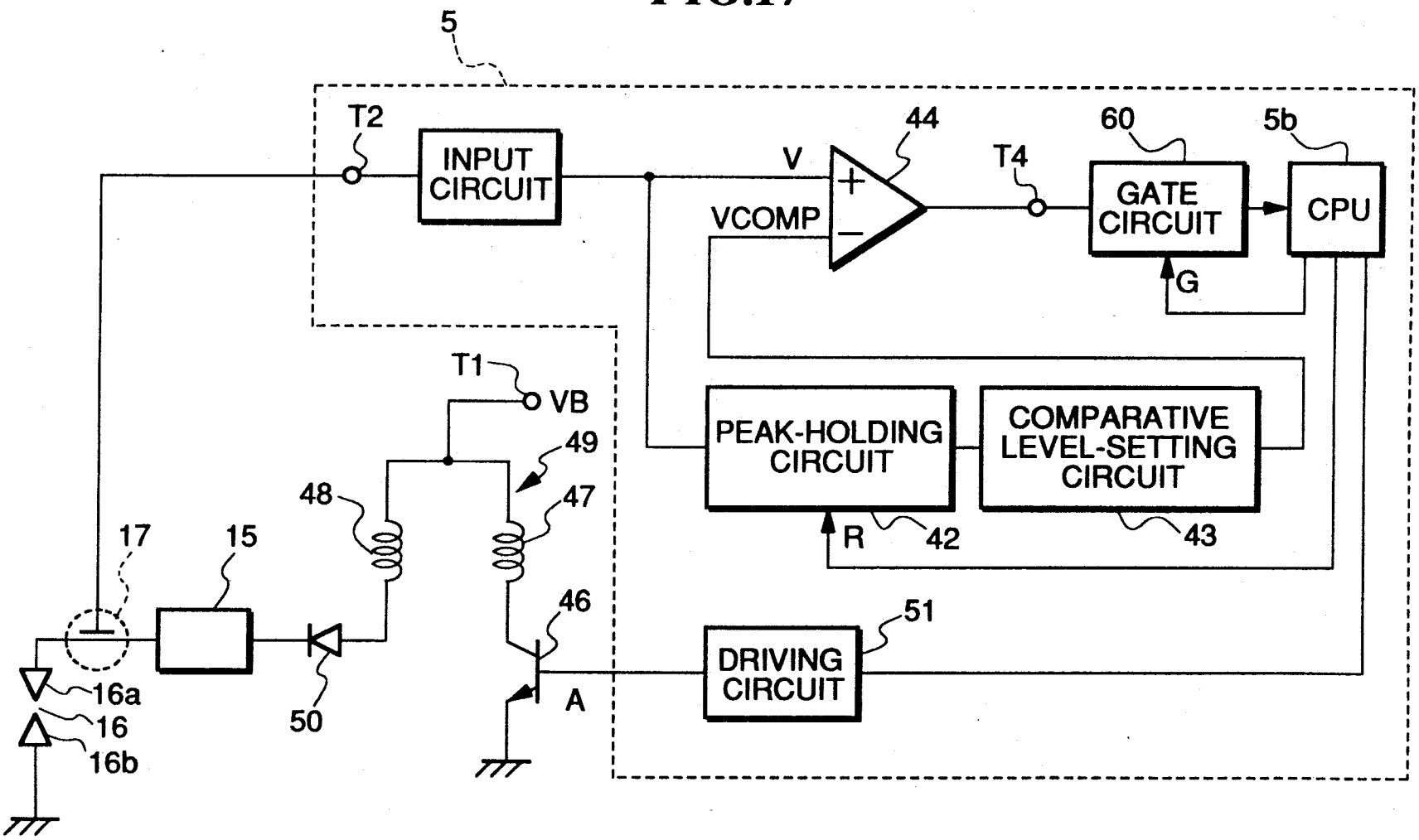
FIG. 17 is a schematic circuit diagram showing the circuit arrangement of the fifth embodiment.

Next, reference is made to FIG. 16 to FIG. **19*b* showing a fifth embodiment of the invention. In FIG. 16 and FIG. 17**, elements and parts corresponding to those in the above described embodiments are designated by identical reference numerals, and detailed description thereof is omitted.

FIG. 16 shows the whole arrangement of an internal combustion engine provided with an exhaust gas recirculation system, as well as with a valve timing changeover device capable of changing the valve timing, and a control system therefore including a misfire-detecting system according to the fifth embodiment.

In the figure, reference numeral 40 designates a valve timing changeover device which changes the valve timing of the intake and exhaust valves between a high-speed valve timing suitable for a high engine rotational speed region and a low-speed valve timing suitable for a low engine rotational speed region. In addition, the changeover of the valve timing in the present embodiment includes changeover of the valve lift amount.

The valve timing changeover device has an electromagnetic valve, not shown, for controlling the changeover of the valve timing, which is electrically connected to the ECU 5 to have its operation controlled by a signal from the ECU 5. The electromagnetic valve effects changeover of hydraulic pressure within the valve timing changeover device between high and low levels, to select the high-speed valve timing and the low-speed valve timing, respectively.

Further, reference numeral 37 designates an atmospheric pressure sensor electrically connected to the ECU 5 for supplying an electric signal indicative of the sensed atmospheric pressure thereto.

The CPU **5*b* determines, based on the signals indicative of the engine operating parameters, various operating conditions of the engine, such as a feedback back control region in which the air-fuel ratio should be controlled to a stoichiometric value in response to an output from the oxygen concentration sensor 12, and an air-fuel ratio open-loop control region other than the feedback control, and calculates a fuel injection period Tout, over which the fuel injection valves 6 are to be opened, and ignition timing θIG of the spark plugs 16, by the use of the following equations (3) and (4), respectively, and also determines occurrence of a misfire based on an output from the sparking voltage sensor 17**, described hereinafter:

$$Tout = TI \times KO2 \times K1 + K2 \quad (3)$$

$$\theta IG = \theta IGMAP + \theta IGCR \quad (4)$$

wherein TI and θIGMAP represent a basic fuel injection period and a basic ignition timing advance value, respectively, both of which are determined according to the engine rotational speed NE and the intake pipe absolute pressure PBA, from a TI map and a θIG map stored in the memory means **5*c*, respectively. In the present embodiment, these maps are each constituted by an EGR-ON map for use when exhaust gas recirculation is being carried out (the exhaust gas recirculation valve 22 is open) and an EGR-OFF map for use when the exhaust gas recirculation is being inhibited (the exhaust gas recirculation valve 22** is closed). Further, the EGR-ON map and the EGR-OFF map are each constituted by one for high-speed valve timing and one for high-speed valve timing. In short, the TI map and the θIG map are each formed by four kinds of maps.

K02 represents an air-fuel ratio correction coefficient which is set in response to the output from the oxygen concentration sensor 12 during the feedback control, and to predetermined values appropriate to operating conditions of the engine when the feedback control is stopped (during the open-loop control).

K1, K2, and θIGCR are other correction coefficients and variables determined according to various engine operating parameter signals indicative of engine operating conditions.

The CPU **5*b* carries out control of the opening of the exhaust gas recirculation valve 22 of the exhaust gas recirculation device 20**, the valve timing changeover control, and the traction control based on the driving wheel speeds WFL, WFR, and the trailing wheel speeds WRL, WRR. Also in the present embodiment, the traction control is for reducing the output torque of the engine by leaning the air-fuel ratio or inhibiting supply of fuel to the engine (fuel cut) when an excessive slip state of either of the driving wheels is detected.

The CPU **5*b* supplies driving signals based on the results of the above calculations and determinations, via the output circuit 5*d* to the fuel injection valves 6, the spark plugs 16, the exhaust gas recirculation valve 22 and the electromagnetic valve of the valve timing changeover device 40**.

FIG. 17 shows the circuit arrangement of the misfire-detecting system according to the fifth embodiment. This circuit arrangement is distinguished from that of the second embodiment in that a gate circuit 60 is connected between the terminal T4 and the CPU **5*b*, and the output of the comparator 44 is connected via the terminal T4 and the gate circuit 60 to the CPU 5*b*. The gate circuit 60 is supplied with a gate signal G from the CPU 5*b* for allowing the output from the comparator 44 to be supplied to the CPU 5*b*** only during a predetermined gating time period.

The operation of the misfire-detecting system constructed as above will be described with reference to a timing chart of FIG. **18*a* to FIG. 18*h*. FIG. 18*a* and FIG. 18*b* show an energization control signal A' and a gating signal G, respectively. FIG. 18*c* to FIG. 18*e* show a sparking voltage characteristic at normal firing of the mixture, while FIG. 18*f* to FIG. 18*h*** show that at FI misfire.

As shown in FIG. **18*a*, in the present embodiment, after the ignition command signal is generated (i.e. after the primary coil 47 is energized over a time period required for ignition, and then deenergized at the time point t0), the primary coil 47 is energized again from a time point t1 to a time point t2 (hereinafter referred to as "re-energization") (recharging command signal). This re-energization is effected by applying a predetermined level of voltage which is low enough not to cause discharge to occur between the electrodes of the spark plug 16 to thereby charge electricity in the floating capacitance of the spark plug 16 and its neighboring circuits. Hereinafter, the voltage applied to the spark plug 16** at the time point t2 will be referred to as the re-charging voltage.

Figures 18A, 18B, 18C, 18D, 18E, 18F, 18G, 18H:
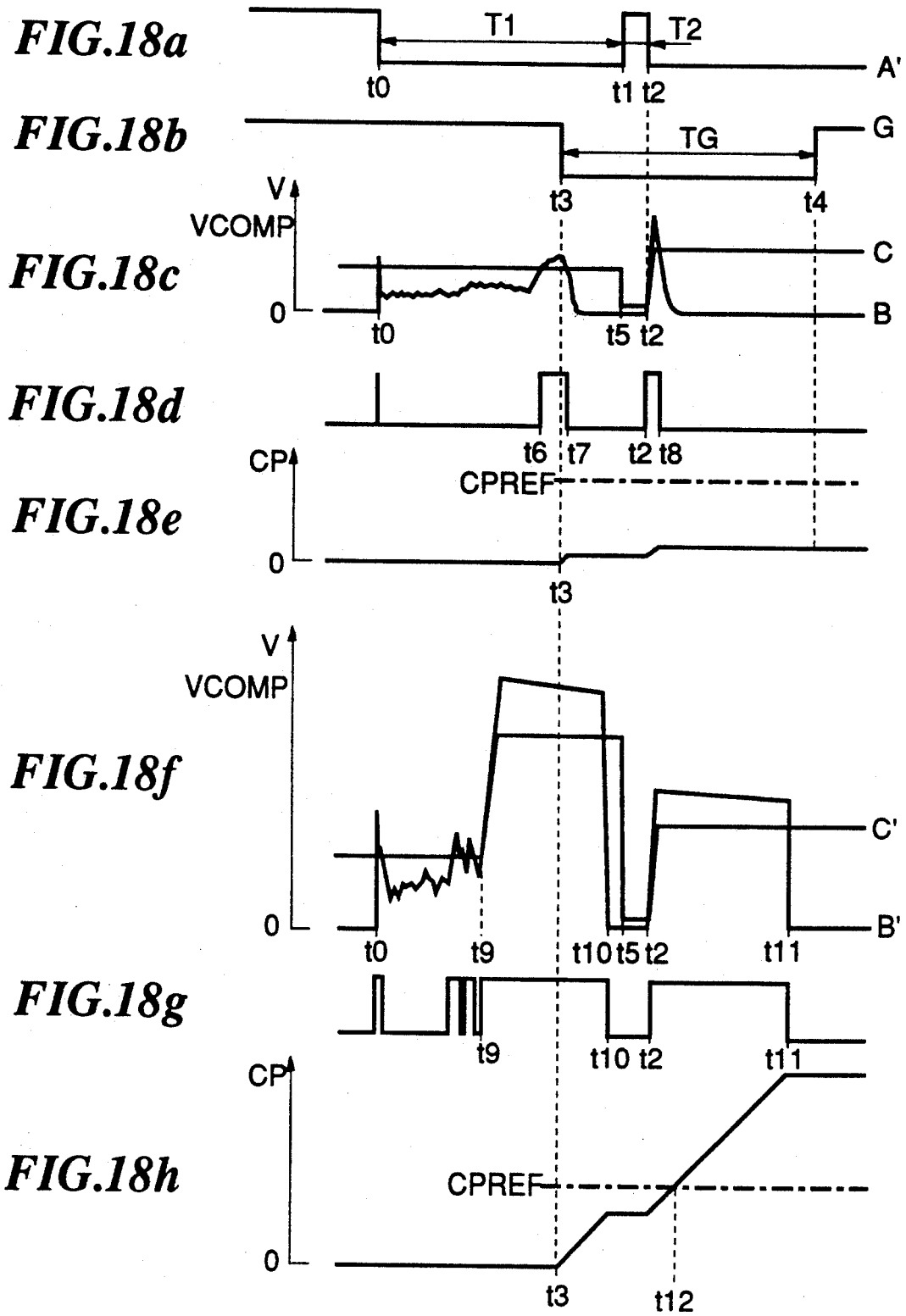

FIG. **18*c* and FIG. 18*f* show changes in the sparking voltage detected (i.e. the output voltage from the input circuit 41) V (B, B') and reference level VCOMP (C, C'). First, reference is made to FIG. 18*c*** to explain the sparking voltage characteristic at normal firing.

Immediately after the time point t0 the ignition command signal A is generated, the sparking voltage rises to such a level as to cause dielectric breakdown of the mixture between the electrodes of the spark plug, and then the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow. The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge (late-stage capacitive discharge) occurs. In this late-stage capacitive discharge state, the voltage between the spark plug electrodes again rises, i.e. in the direction of causing dielectric breakdown of the mixture. However, since the ignition coil 49 then has a small amount of residual energy, the amount of rise of the voltage is small. This is because the electrical resistance of the discharging gap is low due to ionizing of the mixture during firing.

In this connection, electric charge stored in the floating capacitance between the diode 50 and the spark plug 16 (residual charge not discharged between the electrodes) does not discharge toward the ignition coil 49 due to the presence of the diode 50. However, the electric charge is neutralized by ions present in the vicinity of the electrodes of the spark plug 16 and hence the sparking voltage V quickly decreases after termination of the capacitive discharge .

When the re-charging voltage is applied at the time point t2, the sparking voltage V rises, but the resulting charge quickly decrease, similarly to the charge immediately after termination of the late-stage capacitive discharge, due to neutralization of the charge by ions present in the vicinity of the electrodes of the spark plug 16.

On the other hand, the comparative level VCOMP continues to assume a level corresponding to the peak value of the sparking voltage V held after being reset on the last occasion, until a time point t5. A resetting signal R causes the comparative level VCOMP to be held at a predetermined low level (>0) from the time point t5 to the time point t2. At the time point t2, the low level voltage state is canceled (hereinafter, the time point the low voltage state is canceled will be referred to as "resetting (initializing) timing". Accordingly, after the time point t2, the comparative level VCOMP assumes a level corresponding to a peak level of the sparking voltage V resulting from re-charging (in the present embodiment, this level is set to approx. two thirds of the peak value). As a result, the output from the comparator 44 which compares the sparking voltage V with the comparative level VCOMP) goes high in the vicinity of the time point t0, from a time point t6 to a time point t7, and from the time point t2 to a time point t8, as shown in FIG. 18*d*. However, the output from the gate circuit 60 goes high only from a time point t3 to a time point t7, and from the time point t2 to the time point t8, i.e. only within a gating time period TG in which the gating signal G is at a low level.

Next, reference is made to a sparking voltage characteristic indicated in FIG. 18*f*, which is obtained when a FI misfire occurs, which is caused by the supply of a lean mixture to the engine or cutting-off of the fuel supply to the engine due to failure of the fuel supply system, etc. Immediately after the time point t0 of generation of the ignition command signal, the sparking voltage V (B') rises above a level causing dielectric breakdown of the mixture. In this case, the ratio of air in the mixture is greater than when the mixture has an air-fuel ratio close to a stoichiometric ratio, and accordingly the dielectric strength of the mixture is high. Besides, since the mixture is not fired, it is not ionized so that the electrical resistance of the discharging gap of the plug tends to be high. Consequently, the dielectric breakdown voltage becomes higher than that obtained in the case of normal firing of the mixture.

Thereafter, the discharge state shifts to an inductive discharge state, as in the case of normal firing. Also, the electrical resistance of the discharging gap of the plug at the discharge is greater in the case of supply of a lean mixture, etc. than that in the case of normal firing so that the inductive discharge voltage rises to a higher level than at normal firing, resulting in an earlier shifting from the inductive discharge state to a capacitive discharge state (late-stage capacitive discharge). The capacitive discharge voltage upon the transition from the inductive discharge state to the capacitive discharge state is by far higher than that at normal firing, because the voltage of dielectric breakdown of the mixture is higher than that at normal firing.

In this state, since almost no ion is present in the vicinity of the electrodes of the spark plug 16, charge stored between the diode 50 and the spark plug 16 is not neutralized by ions, and at the same time, the diode 50 prevents the charge from flowing back to the ignition coil 49, so that the charge is held as it is, and only when the pressure within the cylinder drops to such a level as to lower the voltage required for discharge to occur between the electrodes of the spark plug 16 to a level equal to the voltage created by the charge, the charge is discharged by way of the electrodes of the spark plug 16. Therefore, if the sparking voltage is higher, discharge takes place earlier.

Thereafter, if the re-charging voltage is applied at the time point t2, the sparking voltage rises again, and the resulting high voltage state continues, since neutralization is not effected by ions between the electrodes, and the diode 50 prevents reverse flow of the charge, as described above. Then, only when the pressure within the cylinder further drops to such a level as to lower the voltage required for discharge to occur between the plug electrodes to a level equal to the sparking voltage resulting from re-charging, the charge is discharged by way of the plug electrodes at the time point t11.

On the other hand, in the example shown in FIG. 18*f*, the comparative voltage level VCOMP (C') assumes a value corresponding to a peak value of the sparking voltage V applied after resetting on the last occasion until the time point t9, and thereafter, it rises with a rise in the sparking voltage, and is held at a level corresponding to a subsequent peak value of the sparking voitage V until the time point t5. During a time period from the time point t5 to t2, it is set to and held at a predetermined low level, and after the time point t2, it assumes a level corresponding to a peak value of the sparking voltage V renewed by the application of the re-charging voltage.

As a result, as shown in FIG. 18*g*, the output from the comparator 44 goes high in the vicinity of the time point t0, shortly before the time point t9, during the time period t9 to t10, and the time period t2 to t11, but the output from the gate circuit 60 goes high only during a time period when the output from the comparator 44 is at a high level during the gating time period TG.

Therefore, as is apparent from comparison between FIG. 18*d* and FIG. 18*g*, by measuring or adding up durations of the comparison result pulses outputted from the gate circuit 60, and comparing the sum of durations measured with a reference value, it is possible to determine occurrence of a misfire.

The misfire determination of the fifth embodiment is carried out by the FIG. 10 program employed in the second embodiment described before. However, in the present embodiment, the determination at the step S41 as to whether or not the misfire monitoring conditions are satisfied is carried out according to a subroutine shown in FIG. 19*a* and FIG. 19*b*, hereinafter described, and further, the comparison result pulses used in the determination at the step S47 is output pulses from the gate circuit 60.

According to the FIG. 10 program adapted to this embodiment, as shown in FIG. 18*e* and FIG. 18*h*, the count value CP does not exceed the predetermined value CPREF when a normal firing occurs, whereas the former exceeds the latter at the time point t12 when a misfire occurs, to thereby detect the misfire.

Figure 19A:
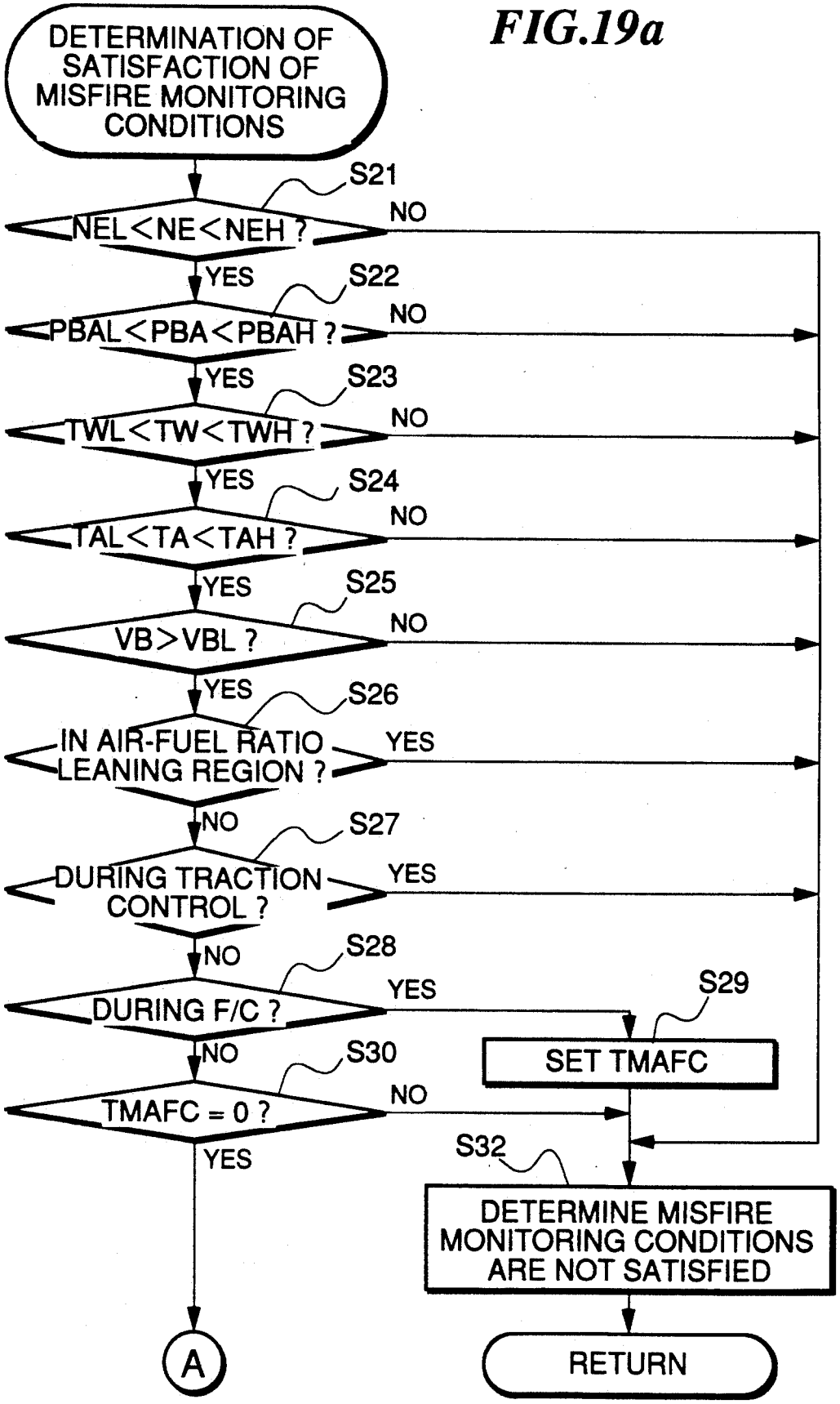
FIG. 19*a* and FIG. 19*b* form together a flowchart of a subroutine for determining whether or not misfire-monitoring conditions are satisfied, which is executed by the fifth embodiment.
Figure 19B:
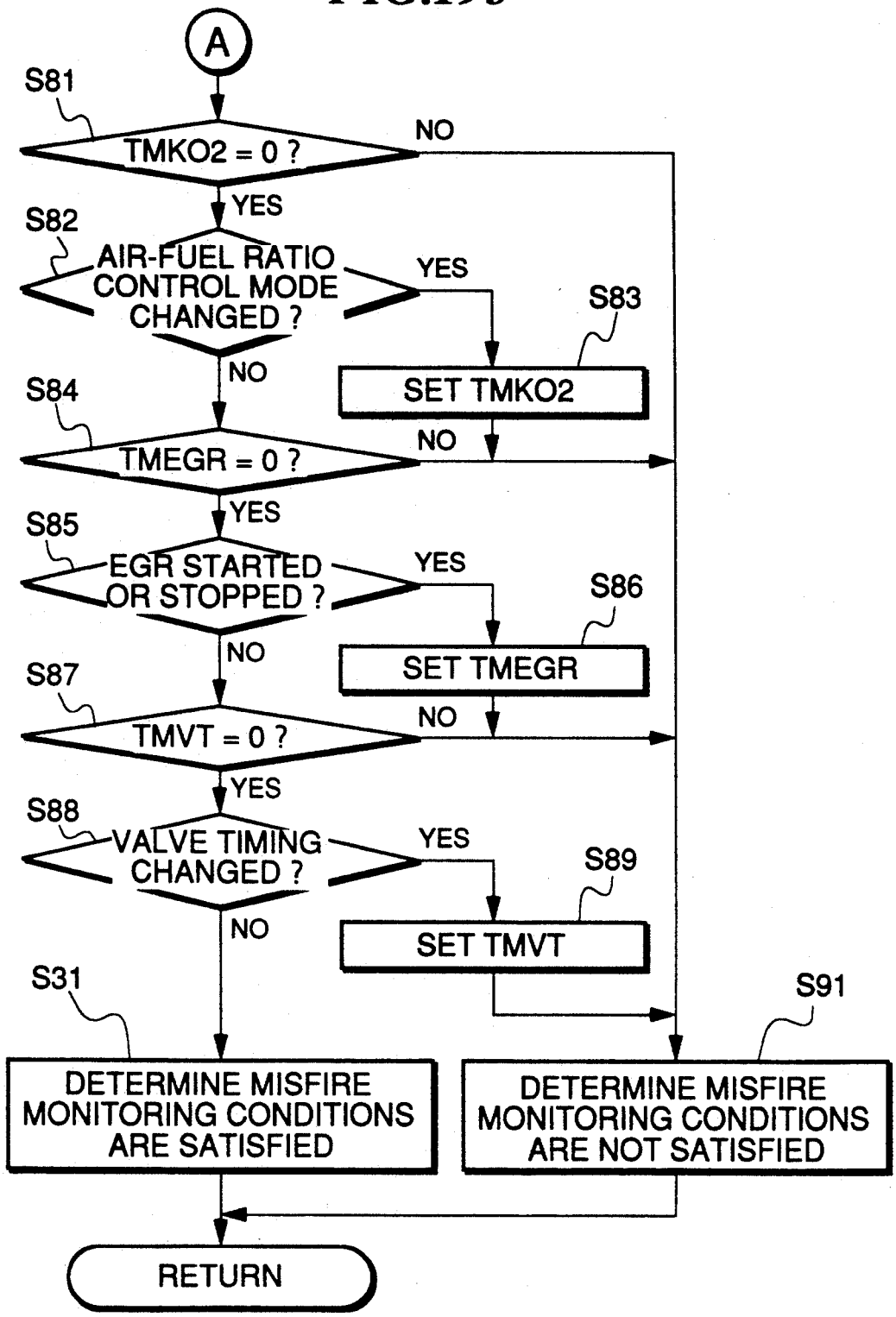

The FIG. 19*a* and FIG. 19*b* subroutine consists of the FIG. 6 subroutine (corresponding steps are designated by identical step numbers in FIG. 19*a*) used in the first and second embodiments, and additional steps shown in FIG. 19*b*.

More specifically, if the answer to the question of the step S30 is affirmative (YES), it is not immediately determined that the monitoring conditions are satisfied, but the program further proceeds to a step S81.

At the step S81, it is determined whether or not a count value TMKO2 of a downcounter timer tTMKO2, which is set to a predetermined time period at a step S83, referred to hereinafter, is equal to 0. If the answer to this question is negative (NO), it is determined at a step S91 that the monitoring conditions are not satisfied.

If the answer to the question of the step S81 is affirmative (YES), i.e. if TMKO2=0, it is determined at a step S82 whether or not a changeover from the air-fuel ratio feedback control to the open-loop control or vice versa has occurred. If the answer to this question is affirmative (YES), the timer tTMKO2 is set to the predetermined time period (e.g. 1 second) and started at the step S83, and if the answer to this question is affirmative (NO), the program proceeds to a step S84.

By executing the steps S81 to S83, it is determined that the misfire monitoring conditions are not satisfied, before the predetermined time period elapses after the air-fuel ratio control is changed from the open-loop control to the feedback control or vice versa. This takes into consideration the fact that immediately after the start or termination of the air-fuel ratio feedback control, the combustion becomes temporarily unstable.

At the step S84, it is determined whether or not a count value TMEGR of a down-counter timer tTMEGR, which is set to a predetermined time period and started at a step S86, referred to hereinafter, is equal to 0. If the answer to this question is negative (NO), it is determined at the step S91 that the monitoring conditions are not satisfied.

If the answer to the question of the step S84 is affirmative (YES), i.e. if TMEGR=0, it is determined at a step S85 whether or not a changeover of the exhaust gas recirculation (hereinafter referred to as "the EGR") from stoppage (OFF) to execution (ON) or vice versa has been effected, i.e. if the present loop is immediately after the start or termination of the EGR control. If the answer to this question is affirmative (YES), the timer tTMEGR is set to the predetermined time period (e.g. 1 second) and started at the step S86, and the program proceeds to the step S91, whereas if the answer is negative (NO), the program proceeds to a step S87.

By executing the steps S84 to S86, it is determined that the monitoring conditions are not satisfied, before the predetermined time period elapses after changeover of the EGR control between ON and OFF. This takes into consideration the fact that immediately after the start or termination of the EGR control, the TI map and the θIG map are changed over between EGR-ON maps and EGR-OFF maps thereof, respectively, which causes temporary fluctuations in the air-fuel ratio and the ignition timing, and hence temporarily makes unstable the combustion unstable.

At the step S87, it is determined whether or not a count value TMVT of a downcounter timer tTMVT, which is set to a predetermined time period and started at a step S89, referred to hereinafter, is equal to 0. If the answer to this question is negative (NO), the program proceeds to the step S91.

If the answer to the question of the step S87 is affirmative (YES), i.e. if TMVT=0, it is determined at a step S88 whether or not a changeover of the valve timing from the high-speed valve timing to the low-speed speed valve timing or vice versa has been effected. If the answer to this question is affirmative (YES), the timer tTMVT is set to the predetermined time period (e.g. 1 second) and started at the step S89, and the program proceeds to the step S91, whereas if the answer is negative (NO), it is determined at a step S31 that the monitoring conditions are satisfied.

By executing the steps S87 to S89, it is determined that the monitoring conditions are not satisfied, before the predetermined time period elapses after changeover of the valve timing. This takes into consideration the fact that immediately after the changeover of the valve timing, the TI map and the θIG map are changed over between maps suitable for the high-speed valve timing and maps suitable for the low-speed valve timing thereof, respectively, which causes temporary fluctuations in the air-fuel ratio and the ignition timing, and hence can temporarily make the combustion unstable.

According to the FIG. 19*a* and FIG. 19*b* program described above, when the engine operating parameters (NE, PBA, TW, TA, VB) do not fall within the respective predetermined ranges, when the air-fuel ratio leaning control or the traction control is being carried out, when the fuel cut is being carried out or the predetermined time period does not elapse after termination of the fuel cut, when the predetermined time period does not elapse immediately after the start or termination of the air-fuel ratio feedback control or the EGR control, and when the predetermined time period does not elapse immediately after changeover of the valve timing, it is determined that the misfire monitoring conditions are not satisfied, whereas in cases other than the above, it is determined that the misfire monitoring conditions are satisfied.

Therefore, the misfire determination by the FIG. 10 program is virtually carried out only when the monitoring conditions are satisfied, that is, only when the combustion within the combustion chamber is stable, whereby it is possible to determine occurrence of regular misfires more accurately.

Figure 20A:
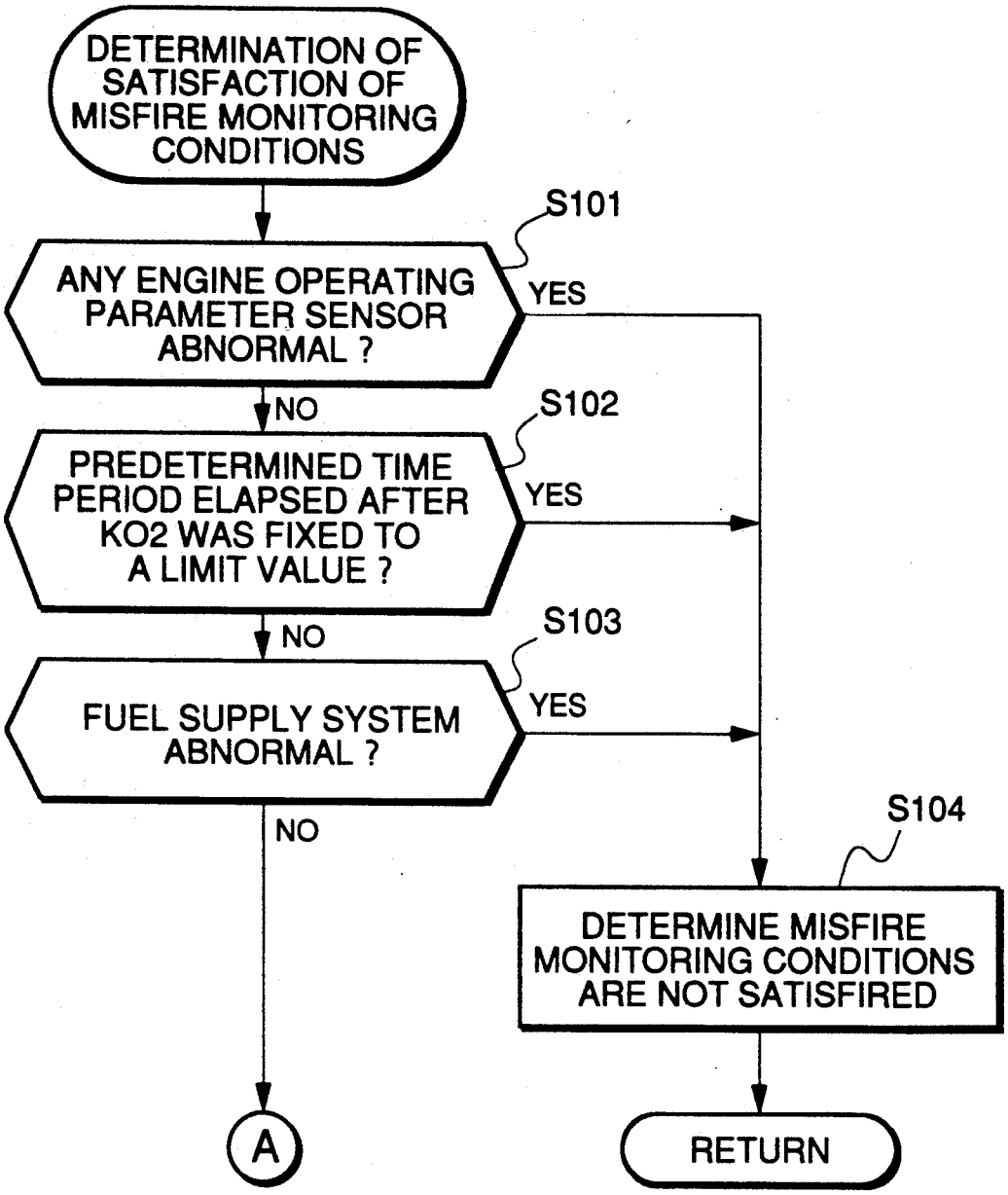
FIG. 20*a* and FIG. 20*b* form together a flowchart of a subroutine for determining whether or not misfire-monitoring conditions are satisfied, which is executed by a sixth embodiment of the invention.
Figure 20B:
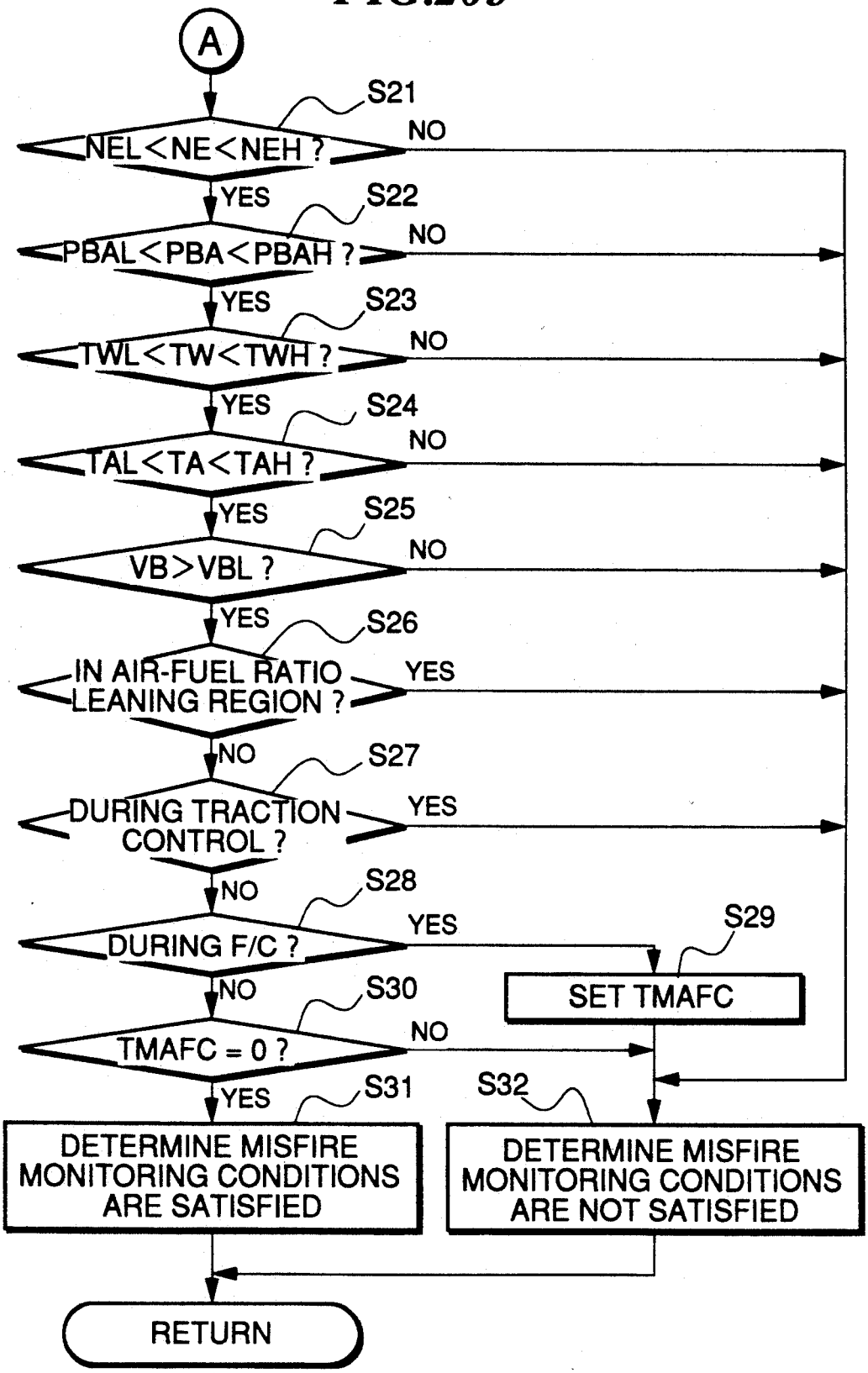

Next, reference is made to FIG. 20*a* and FIG. 20*b* showing the six embodiment of the invention.

This embodiment is distinguished from the fifth embodiment in that in determining occurrence of a misfire by the FIG. 10 program, a subroutine shown in FIG. 20*a* and FIG. 20*b* is employed in determining of satisfaction of the misfire monitoring conditions at the step S41 of the FIG. 10 program, instead of the FIG. 19*a* and FIG. 19*b* subroutine described above. The FIG. 20*a* and FIG. 20*b* subroutine consists of the FIG. 6 subroutine (corresponding steps are designated by identical step numbers in FIG. 20*b*) used in the first and second embodiments, and additional steps S101 to S104 executed before execution of the steps of the FIG. 6 subroutine, shown in FIG. 20*a*.

More specifically, according to the FIG. 20*a* and FIG. 20*b* subroutine, first at a step S101, it is determined whether or not at least one of the sensors for detecting engine operating parameters, such as the intake pipe absolute pressure sensor 7, the engine coolant temperature sensor 9, the engine rotational speed sensor 10, and the intake air temperature sensor 8, has been detected to be faulty. If the answer to this question is affirmative (YES), it is determined at a step S104 that the misfire monitoring conditions are not satisfied. The detection of faulty operation of the sensors is carried out by another subroutine, not shown, e.g. by determining whether or not the outputs from the sensors fall below respective predetermined upper limits, i.e. within respective normal ranges.

Outputs from engine operating parameter sensors are used in determination of the reference value CPREF for the misfire determination, as described hereinbefore, and also used at the steps S21 to S25 of this subroutine for determining satisfaction of monitoring conditions. Therefore, if any of the sensors used for these determination is detected to be faulty, determination of a CPREF value and determination of the monitoring conditions cannot be effected properly. Further, if a sensor is detected to be faulty, the output from the sensor is forcedly set to a predetermined value (e.g. 50° C. in the case of the engine coolant temperature) for failsafe purposes, so that this predetermined value affects the ignition timing and the fuel injection period to prevent the misfire determination from being carried out properly. Therefore, in this embodiment, if at least one of the sensors is detected to be faulty, the misfire determination is inhibited, which enables to prevent an inaccurate misfire determination.

If the answer to the question of the step S101 is negative (NO), i.e. if no sensor is detected to be faulty, it is determined at a step S102 whether or not a predetermined time period (e.g. 5 seconds) has elapsed after the air-fuel ratio correction coefficient KO2 was fixed to a richer limit or a leaner limit. If the answer to this question is affirmative (YES), the program proceeds to the step S104 to determine that the misfire monitoring conditions are not satisfied. However, this determination is carried out only during the air-fuel ratio feedback control based upon the output from the oxygen concentration sensor 12, and if not during the air-fuel ratio feedback control is not being carried out, the program jumps to a step 103.

The determination at the step S102 takes into consideration the fact that if the coefficient KO2 has continued to be equal to a limit value, the air-fuel ratio deviates from a desired value, which prevents the reference value CPREF from being set to a proper value, and hence the misfire determination from being properly carried out.

If the answer to the question of the step S102 is negative (NO), it is determined at the step S103 whether or not the fuel supply system (fuel injection valves, fuel pressure regulator, etc.) is detected to be faulty. If the answer to this question is affirmative (YES), the program proceeds to the step S104 to determine dissatisfaction of the monitoring conditions. Specifically, the determination at the step S103 is effected by determining whether or not an average value KO2AVE of KO2 values assumed over a long time period (an average value continually calculated from the start of service of the engine and stored in a nonvolatile memory even during stoppage of the engine) falls outside a predetermined range. That is, if the average value KO2AVE falls outside the predetermined range, it is determined that the fuel supply system is faulty.

The determination at the step S103 takes into consideration the fact that while the fuel supply system is detected to be faulty, the coefficient KO2 is fixed to a predetermined value, and hence similarly to the case of the coefficient KO2 having continued to be one of the aforementioned limits, it is impossible to carry out the misfire determination properly. Further, in such a state of the engine, the whole control system for the engine suffers from some kind of abnormality, and hence there is a high possibility that the combustion in the engine is not normal. Therefore, the misfire determination is inhibited to prevent an erroneous determination of a misfire resulting from the possible abnormality.

Although in the present embodiment, the misfire determination is inhibited when the fuel supply system is detected to be faulty, this is not limitative, but the misfire determination may be inhibited when abnormality is detected as to any system for controlling the operation of engine, including the EGR system, an evaporative emission control system, etc.

If the answer to the question of the step S103 is negative (NO), the program proceeds to the step S21, et seq., which are already described hereinbefore with reference to FIG. 6.

Next, a seventh embodiment of the invention will be described with reference to FIG. 21.

Figure 21:
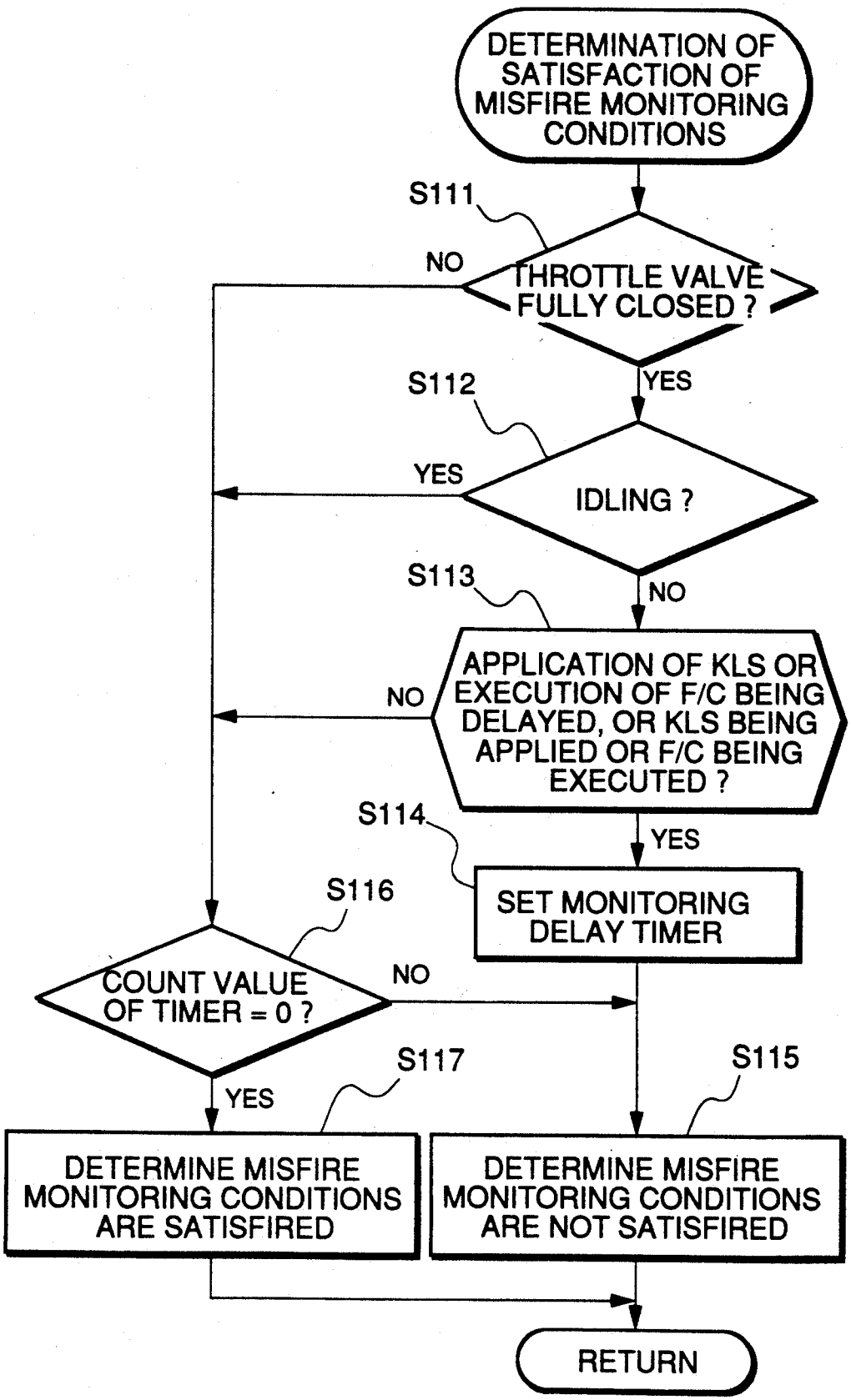
FIG. 21 is a flowchart of a subroutine for determining whether or not misfire-monitoring conditions are satisfied, which is executed by a seventh embodiment of the invention.

This embodiment is distinguished from the fifth and sixth embodiments in that the determination whether or not the misfire monitoring conditions are satisfied, which is carried out at the step S41 of the FIG. 10 program is made by the use of a subroutine shown in FIG. 21.

In the present embodiment, the fuel injection period Tout is calculated by the use of the following equation (5):

$$Tout = TI \times KO2 \times KLS \times K1 + K2 \quad (5)$$

where TI, KO2, K1 and K2 are the same as defined in the equation (1) given hereinbefore, and KLS represents a leaning correction coefficient which is set to a value smaller than 1.0 according to the engine coolant temperature TW, when the engine lies in a predetermined mixture leaning region in which the engine rotational speed NE is above a predetermined value, and at the same time the intake pipe absolute pressure PBA is below a predetermined value.

The subroutine of FIG. 21 is executed at regular time intervals or at predetermined timing relative to ignition of each spark plug.

First, at a step S111, it is determined whether or not the throttle valve 3 is fully closed. If the answer to this question is affirmative (YES), i.e. if the throttle valve 3 is fully closed, the program proceeds to a step S112, where it is determined whether or not the engine is idling. This determination is made by determining whether or not the engine rotational speed NE is below a predetermined value and at the same time the intake pipe absolute pressure PBA is below a predetermined value. If the answer to this question is negative (NO), i.e. if the throttle valve 3 is fully closed and at the same time the engine is not idling, the program proceeds to a step S113.

At the step S113, it is determined whether or not a predetermined time period for delaying the start of the air-fuel ratio leaning control or fuel cut (F/C) has not elapsed after the throttle valve 3 was fully closed, or the air-fuel ratio leaning control or the fuel cut is being carried out. The determination of the air-fuel ratio leaning control is made by determining whether or not the engine is in the aforementioned predetermined mixture leaning region in which the engine rotational speed NE is above the predetermined value, and at the same time the intake pipe absolute pressure PBA is below the predetermined value, in which region the leaning correction coefficient KLS is set to the predetermined value smaller than 1.0. Further, the determination of fuel cut is carried out by determining whether or not the engine rotational speed NE is above a predetermined value dependent on the engine coolant temperature and at the same time the intake pipe absolute pressure PBA is below a predetermined value dependent on the engine rotational speed NE.

If the answer to the question of the step S113 is affirmative (YES), i.e. if the predetermined time period for delaying the air-fuel ratio leaning control or fuel cut has not elapsed, or if the air-fuel ratio leaning control or fuel cut is being carried out, the program proceeds to a step S114, where a monitoring delay timer is set to a predetermined time period (e.g. 5 seconds).

Thus, if the throttle valve 3 is fully closed and at the same time the engine is not idling, and if the predetermined time period for delaying start of the air-fuel ratio leaning control or fuel cut has not elapsed, or if the air-fuel ratio leaning control or fuel cut is being carried out, the monitoring delay timer is set to the predetermined time period, and then it is determined at a step S115 that the monitoring conditions are not satisfied.

On the other hand, if the answer to the question of the step S111 is negative (NO), or if the answer to the question of the step S112 is affirmative (YES), i.e. if the throttle valve 3 is not fully closed or if the engine is not idling, the program proceeds to a step S116. If the answer to the question of the step S113 is negative (NO) as well, i.e. if the predetermined time period for delaying start of the air-fuel ratio leaning control or fuel cut has elapsed, or if the air-fuel ratio leaning control or fuel cut is not being carried out, as well, the program proceeds to the step S116.

At the step S116, it is determined whether or not the count value of the monitoring delay timer set at the step S114 is equal to 0. If the answer to this question is affirmative (YES), i.e. if the predetermined time period (5 seconds) has elapsed and the count value of the timer is equal to 0, it is determined at a step S117 that the monitoring conditions are satisfied, whereas if the answer is negative (NO), i.e. if the predetermined time period (5 seconds) has not elapsed, the program proceeds to the step S115.

Thus, according to the present embodiment, if the throttle valve 3 is fully closed and at the same time the engine is idling, the misfire detection is immediately inhibited before the lapse of the predetermined time period for delaying the air-fuel ratio control leaning or fuel cut, which enables to prevent an erroneous determination of occurrence of a misfire during the predetermined delaying time period. Further, the misfire detection is inhibited over the predetermined time period (e.g. 5 seconds) immediately after termination of the air-fuel ratio leaning control or fuel cut, during which the combustion is unstable, which also enables to prevent an erroneous determination of occurrence of a misfire over this time period.

The above described embodiments may be modified in many ways. For example, in the second, fourth, fifth, sixth and seventh embodiments, if the misfire monitoring conditions are not satisfied, the misfire detection or determination is inhibited. This is not limitative, but the reference value CPREF may be changed to a value which makes it impossible to determine occurrence of a misfire when the monitoring conditions are not satisfied. Further alternatively, this may be achieved not by changing the reference value CPREF but by changing the comparative voltage level VCOMP.

Figure 22:
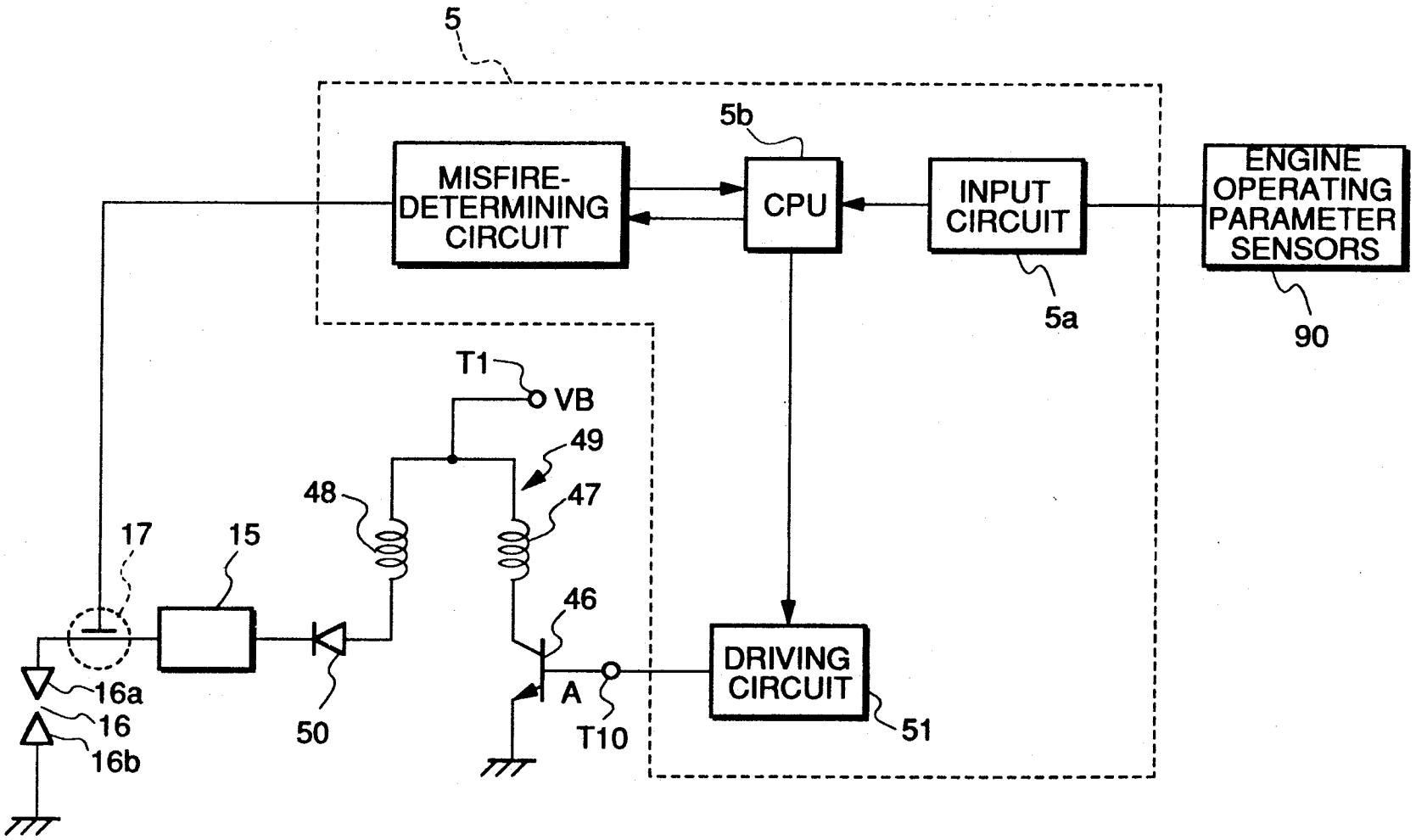
FIG. 22 is a diagram showing the circuit arrangement of an eighth embodiment of the invention.
Figure 23:
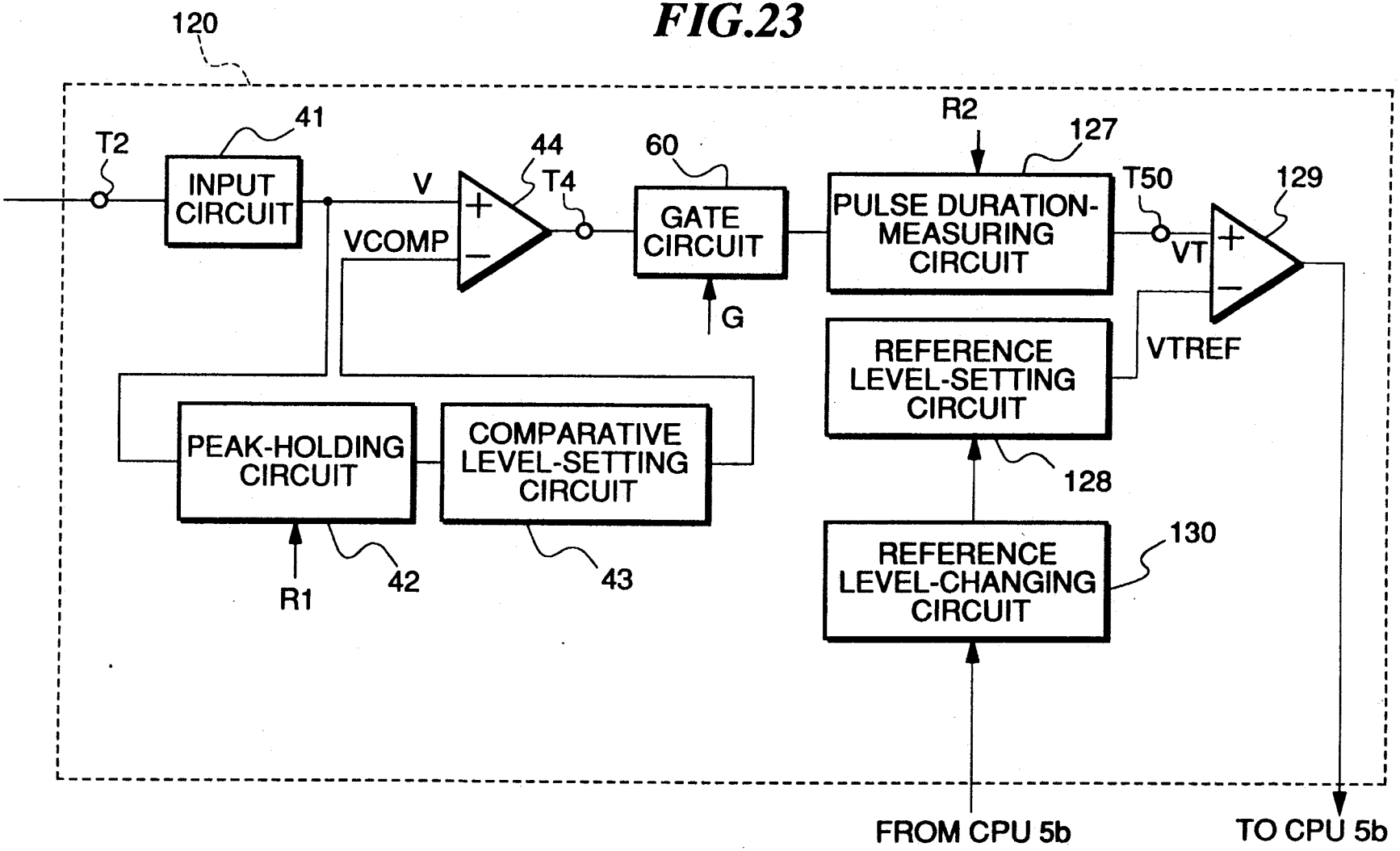
FIG. 23 is a circuit diagram showing a misfire-determining circuit appearing in FIG. 22.
Figure 24:
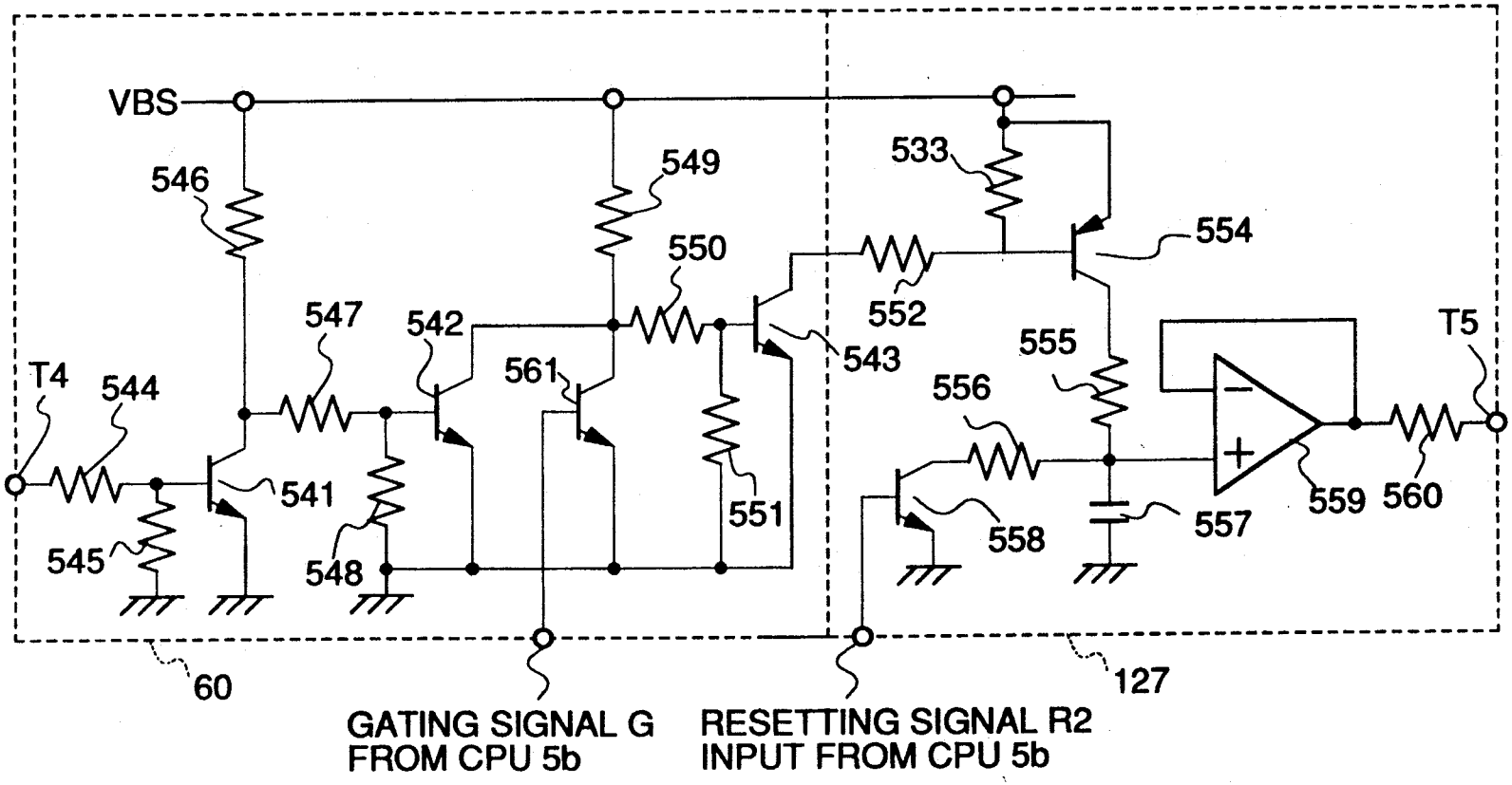
FIG. 24 is a circuit diagram showing details of a part of the circuit in FIG. 23.

Next, an eighth embodiment of the invention and variations thereof will be described with reference to FIG. 22 to FIG. 29. In FIG. 22, FIG. 23 and FIG. 24, elements and parts corresponding to those in the previous embodiments are designated by identical reference numerals.

FIG. 22 shows the circuit arrangement of a misfire-detecting system according to the eighth embodiment.

In the figure, a feeding terminal T1, which is supplied with with supply voltage VB, is connected to an ignition coil 49 comprised of a primary coil 47 and a secondary coil 48. The primary and secondary coils 47, 48 are connected with each other at one ends thereof. The other end of the primary coil 47 is connected to a collector of a transistor 46 The transistor 46 has its base connected to an input terminal T10 through which an energization control signal A is supplied, and its emitter grounded. The other end of the secondary coil 48 is connected to an anode of a diode 50 which has its cathode connected via a distributor 15 to a center electrode **16*a* of the spark plug 16. The spark plug 16 has its grounding electrode 16*b*** grounded.

Provided at an intermediate portion of a connection line 150 connecting between the distributor 15 and the center electrode **16*a*, is a sparking voltage sensor 17 which is electrostatically coupled to the connection line 150 to form a capacitor having a capacitance of several PF's together with the connection line 150, and the output of the sparking voltage sensor 17 is connected to a misfire-determining circuit 120 within the ECU 5. The misfire-determining circuit 120 is connected to the CPU 5*b* to supply results of the misfire determination thereto. The CPU 5*b*** controls timing for carrying out the misfire determination.

Connected to CPU **5*b* are various engine operating parameter sensors 90 for detecting operating parameters of the engine, including the engine rotational speed NE sensor, the intake pipe absolute pressure PBA sensor, and the engine coolant temperature TW sensor, for supplying the CPU 5*b* with the detected operating parameter values. Further connected to the CPU 5*b* via a driving circuit 51 and the input terminal T10 is the base of the transistor 46** to supply the energization control signal A thereto.

FIG. 23 shows details of the misfire-determining circuit 120. An input terminal T2 thereof is connected via an input circuit 41 to a non-inverting input terminal of a first comparator 44. The output of a peak-holding circuit 42 is connected via a comparative level-setting circuit 43 to an inverting input terminal of the first comparator 44. The peak-holding circuit 42 is supplied with a resetting signal R1 from the CPU **5*b*** for resetting at a proper time a peak value of the sparking voltage held by the peak-holding circuit.

An output from the first comparator circuit 44 is supplied via a pulse duration-measuring circuit 127 which measures a time period over which the output from the first comparator 44 is at a high level, to the gate circuit 60 which in turn allows its input signal to be output therefrom during its gating time period, and supplies voltage VT commensurate with the measured time period to a non-inverting input terminal of a second comparator 129. Connected to an inverting input terminal of the second comparator 12 is a reference level-setting circuit 128 for supplying the former with a reference voltage VTREF for determining occurrence of a misfire. The reference level-setting circuit 128 is formed by voltage-dividing resistances including a variable resistance the resistance value of which is controlled by an output from a reference level-changing circuit 130, referred to hereinafter. If a condition of VT>VTREF holds, an output from the second comparator 129 goes high, whereby it is determined that a misfire has occurred. The reference level-setting circuit 128 is connected via the reference level-changing circuit 130 to the CPU 5*b*. The reference level-changing circuit 130 changes the reference level which is set by the reference level-setting circuit 128, according to the controlled air-fuel ratio of a mixture supplied to the engine. For example, if the controlled air-fuel ratio shifts toward a leaner side, the circuit 130 increases the reference level, while if the controlled air-fuel ratio shifts toward a richer side, the circuit lowers the reference level. In addition, the CPU 5*b* supplies a gating signal G determining the gating time period over which the gate circuit 60 allows its input signal to pass therethrough, and a resetting signal R2 determining resetting timing of the duration-measuring circuit 127.

Details of the input circuit 41, the peak-holding circuit 42 and the comparative level-setting circuit 43 are shown in FIG. 8.

FIG. 24 shows details of the gate circuit 60 and the pulse duration-measuring circuit 127. The gate circuit 60 is comprised of three serially-connected inverting circuits formed by transistors 541 to 543 and resistances 544 to 551. Further, a transistor 561 is connected between a collector of the transistor 542 and ground, and has its base supplied with the gating signal G from the CPU 5*b*. Accordingly, during a gating time period in which the gating signal G is at a low level, potential at a collector of the transistor 543 goes high and low as the voltage at the input terminal T4 goes high and low, whereas when the gating signal G is at a high level, the potential at the collector of the transistor 543 is at a high level irrespective of the voltage at the terminal T4. The collector of the transistor 543 is connected via a resistance 552 to a base of a transistor 554, the base being also connected via a resistance 553 to a power supply line VBS. The transistor 554 has its emitter directly connected to the power supply line VBS and its collector grounded via a resistance 555 and a capacitor 557. The junction of the resistance 555 with the capacitor 557 is connected via an operational amplifier 559 and a resistance 560 to an output terminal T5. The operational amplifier 559 operates as a buffer amplifier. The junction of the resistance 555 with the capacitor 557 is also connected via a resistance 556 to a collector of a transistor 558, which in turn has its emitter grounded, and its base supplied with the resetting signal R2 from the CPU 5*b*.

The FIG. 24 circuit operates as follows: When the gating signal G is at a low level and the voltage at the input terminal T4 is at a high level, the collector of the transistor 543 goes low, to turn the transistor 554 on whereby the capacitor 557 is charged, whereas when the gating signal G is at a high level or the voltage at the terminal T4 is at a low level, the transistor 554 is turned off to stop charging of the capacitor 557. As a result, the output terminal T5 supplies the voltage VT which is proportional to the length of a time period over which the pulse signal supplied to the terminal T4 is at a high level during the gating time period.

The operation of the misfire-detecting system constructed as above will be described with reference to FIG. 25*a* to FIG. 25*i*.

Figures 25A, 25B, 25C, 25D, 25E, 25F, 25G, 25H, 25I:
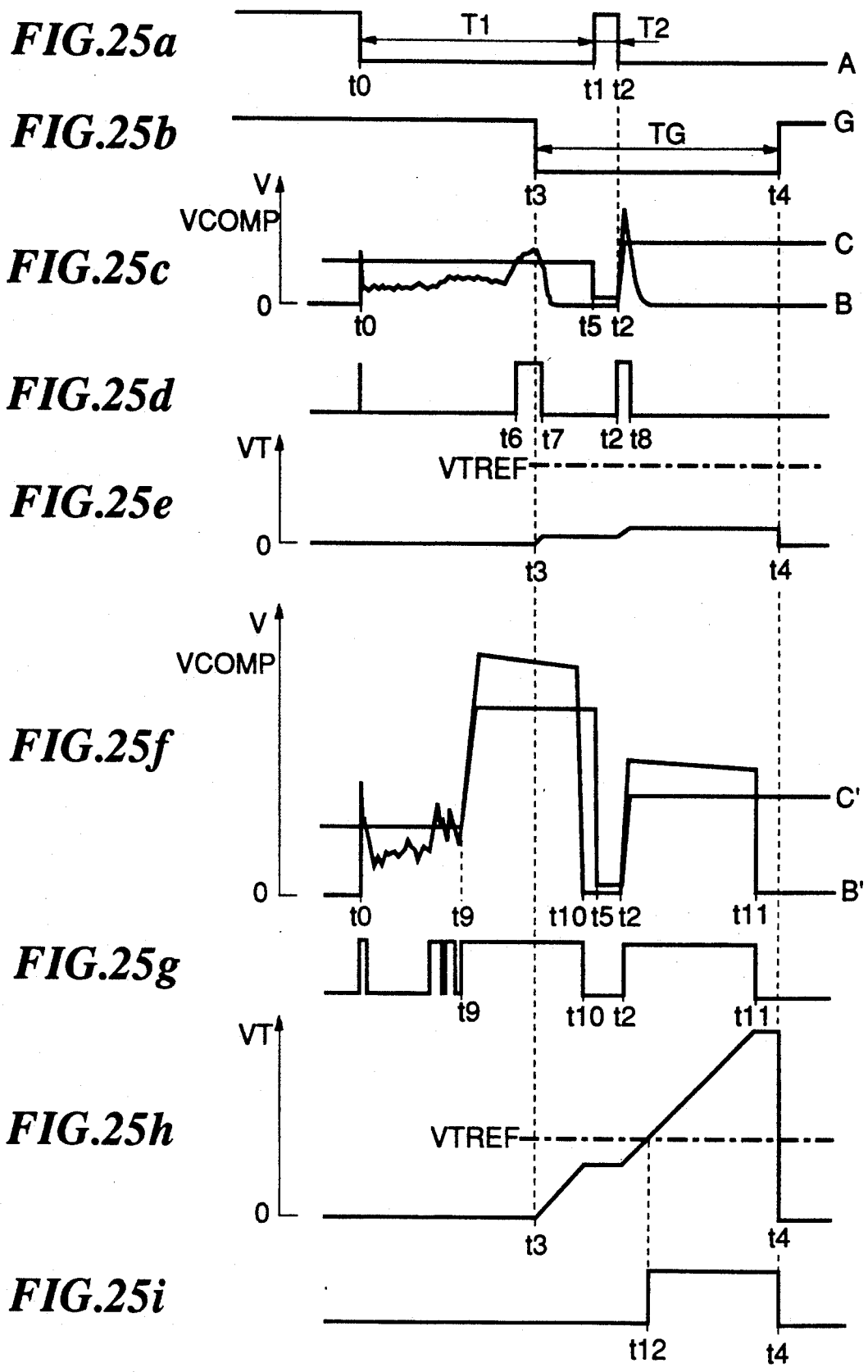

FIG. 25*a* to FIG. 25*i* form a timing chart similar to FIG. 18*a* to FIG. 18*h*, which is useful in explaining the operation of the misfire-detecting system according to the present embodiment. FIG. 25*d* and FIG. 25*g* show changes in the output from the first comparator 44 occurring at a normal firing and at a misfire, respectively, FIG. 25*e* and FIG. 25*h* show changes in the output VT from the pulse duration-measuring circuit 127 at a normal firing and at a misfire, respectively, and FIG. 25*i* shows changes in the output from the second comparator 129 at a misfire.

The operation of the circuit is identical to that of the fifth embodiment given hereinbefore with reference to FIG. 18*a* to FIG. 18*h*, except for the following point:

According to the present embodiment, at a normal firing, the output from the first comparator 44 which makes comparison between the sparking voltage V and the comparative level VCOMP changes as shown in FIG. 25*d*, i.e. it goes high in the vicinity of a time point t0, from a time point t6 to a time point t7, and from a time point t2 to a time point t8, while the output from the gate circuit 60 assumes a high level only from a time point t3 to the time point t7 and from the time point t2 to the time point t8 during which the gating signal G is at a low level. As a result, the output VT from the pulse duration-measuring circuit 127 changes as shown in FIG. 25*e* without exceeding the reference voltage VTREF, so that it is determined that combustion is normal.

On the other hand, when a misfire occurs, the output from the first comparator 44 assumes a high level, as shown in FIG. 25*g*, in the vicinity of the time point t0, shortly before a time point t9, from the time point t9 to a time point t10, and from the time point t2 to a time point t11, while the output from the gate circuit 126 assumes a high level only during time periods over which the output from the first comparator 44 is at a high level during the gating time period TG. Accordingly, the output VT from the pulse duration-measuring circuit 127 changes as shown in FIG. 25*h*, that is, it exceeds the reference voltage VTREF at a time point t12, and hence the output from the second comparator 129 assumes a high level from the time point t12 to a time point t4, whereby an FI misfire is detected.

As shown in FIG. 25*f*, in the case where the sparking voltage becomes relatively high during the late-stage capacitive discharge, the sparking voltage drops earlier (at the time point t10), and at this time point the output VT from the pulse duration-measuring circuit 127 does not exceed the reference voltage VTREF, so that it is impossible to detect an FI misfire. Therefore, in the present embodiment, at the time point t2, re-charging voltage which is low enough not to cause discharge between the electrodes of the plug is applied to the spark plug, which enables to detect an FI misfire positively even if the sparking voltage V becomes high as in the above-mentioned case.

Further, in the present embodiment, the gating time period (the time point t3 to the time point t4) during which the gate circuit 60 is open, i.e. the gate circuit 60 allows its input signal to pass therethrough, is started from a time corresponding to the termination of the late-stage capacitive discharge. However, the time point t4 at which the gating time period TG terminates may be set to any time point before the rotor head of the distributor 15 passes the following segment (before the rotation of the crank angle goes through 120 degrees from the time point of firing).

Further, in the present embodiment, the pulse duration-measuring circuit 127 is reset at the time point t4.

Further, in the above described example, the timing of resetting the peak-holding circuit 42 is simultaneous with application of the re-charging voltage. This takes into consideration the fact that during the late-stage capacitive discharge and immediately thereafter, the level of the sparking voltage V is unstable, and hence if the peak-hodling circuit 42 is reset at any time point during the mentioned time period, the comparative level VCOMP also becomes unstable, which makes it impossible to carry out an accurate misfire determination. On the other hand, if resetting of the peak-holding circuit 42 is too delayed from the time point of application of the re-charging voltage, the re-charging becomes meaningless. Therefore, although the resetting timing need not necessarily be simultaneous with the application of the re-charging voltage, it should be set in the vicinity of the time point the re-charging voltage is applied to the spark plug.

Figure 26:
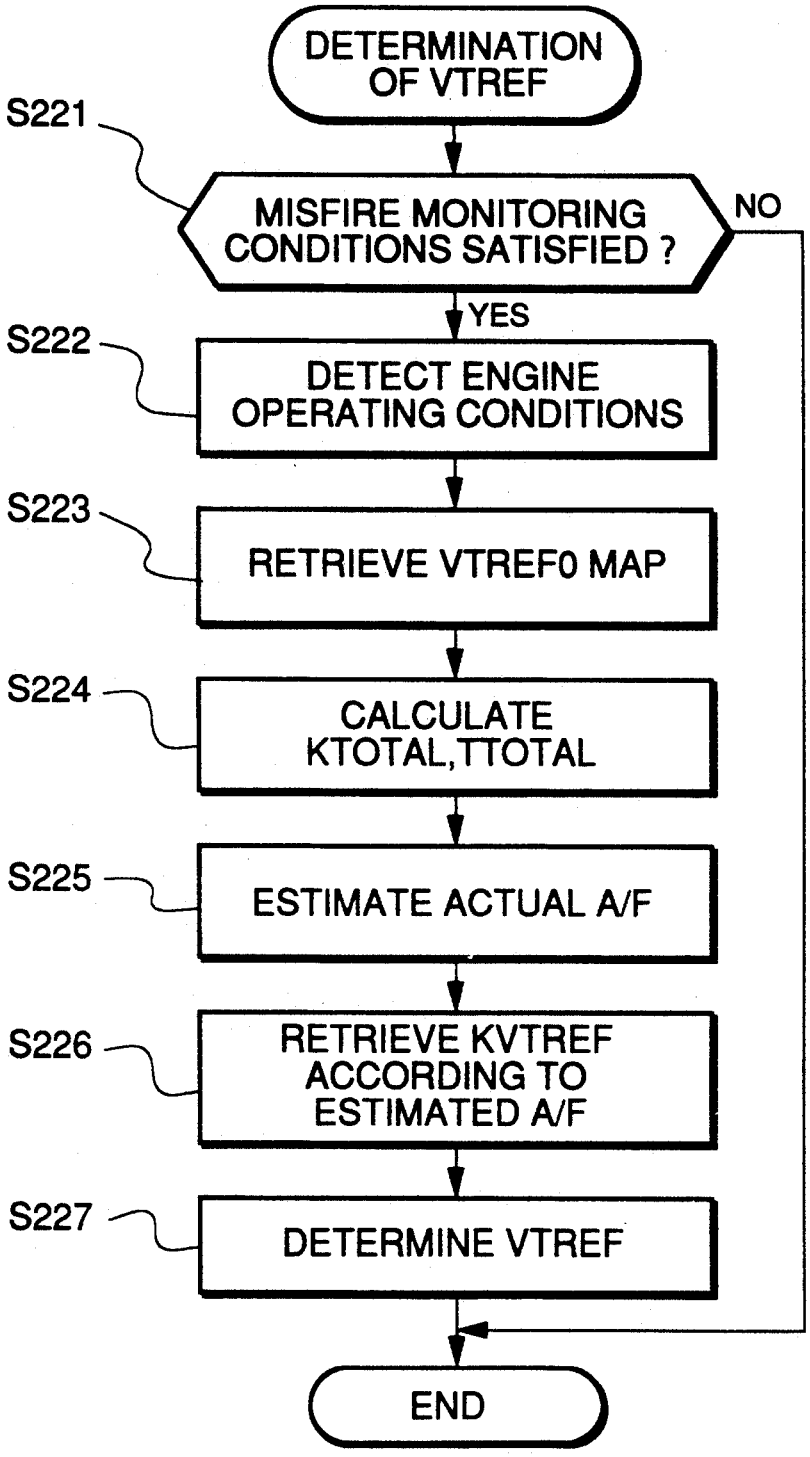
FIG. 26 is a flowchart of a subroutine for determining a basic value VTREF0 of a reference value VTREF.

FIG. 26 shows a program for setting the reference level VTREF, which is executed at proper timing whenever each firing is carried out.

Figure 27A:
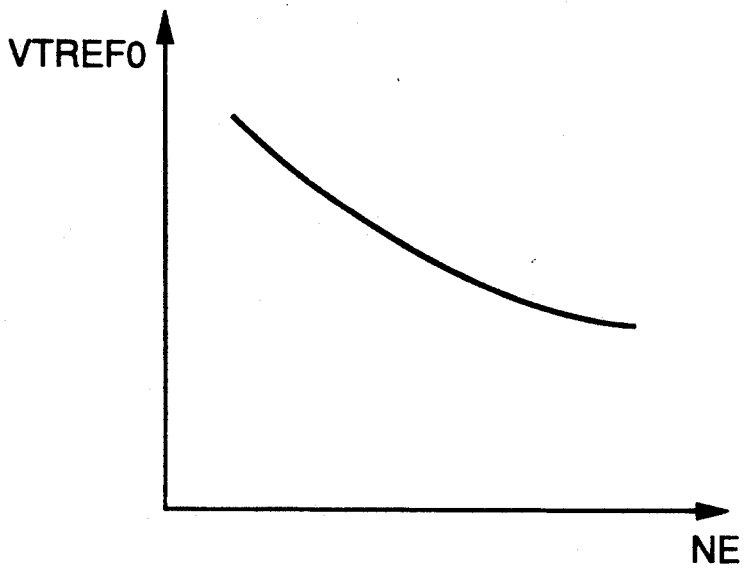
FIG. 27*a* and FIG. 27*b* are diagrams which are useful in explaining how map values are set in a map of the basic value VTREF0 of the reference value VTREF.
Figure 27B:
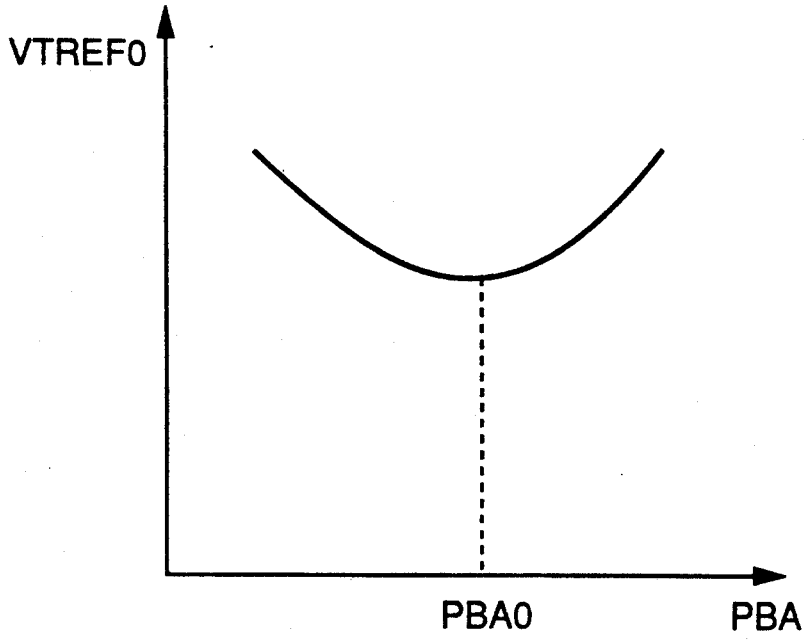
Figure 28:
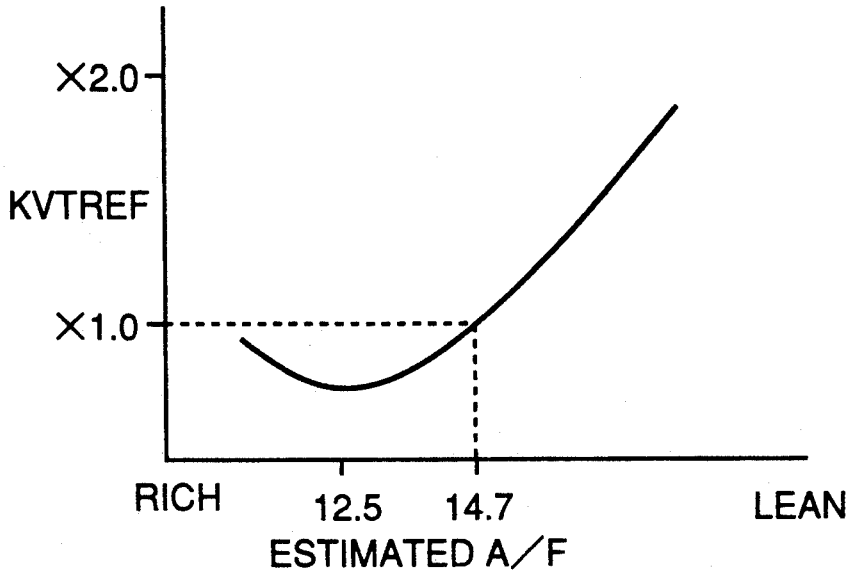
FIG. 28 shows a map for determining a correction coefficient KVTREF for correcting the basic value VTREF0.

First, at a step S221, it is determined whether or not the misfire monitoring conditions are satisfied. The misfire monitoring conditions are satisfied when no abnormaltiy is detected in respect of sensors for detecting engine operating parameters or control parameter values such as the fuel injection period, and at the same time when the engine is in an operating condition in which the misfire determination should be carried out, in which e.g. the engine rotational speed NE, the intake pipe absolute presssure PBA, the travelling speed of the vehicle on which the engine is installed, etc. fall within respective moderate ranges. If the answer to the question of the step S221 is negative (NO), the program is immediately terminated, whereas if the answer is affirmative (YES), the program proceeds to a step S222, where an operating condition in which the engine is operating is detected from the engine rotational speed NE, the intake pipe absolute pressure PBA, etc. At the following step S223, a VTREF0 map is retrieved to read a basic vlaue VTREF0 of the reference level VTREF. The VTREF0 map is set such that optimum values of the basic value VTREF0 are provided, which correspond, respectively, to predetermined values of the engine rotational speed NE and those of the intake pipe absolute pressure PBA. More specifically, according to the map, the basic value VTREF0 decreases as the engine rotational speed NE increases, as shown in FIG. 27*a*. This is based upon the fact that the higher the engine rotational speed NE, the shorter the interval of occurrence of pulses of the ignition command signal, so that the pulse duration of the comparative result pulse signal tends to decrease irrespective of occurrence of a misfire as the engine rotational speed NE increases. Further, according to the map, the basic value VTREF0 assumes the minimum value when the intake pipe absolute pressure value PBA assumes a predetermined intermediate value PBA0, as shown in FIG. 27*b*. This takes into consideration a variaton in the pressure within the combustion chamber caused by a variation in the intake pipe absolute pressure PBA, and hence the resulting variation in the required sparking voltage. The optimum basic reference value VTREF0 varies with the type of the engine (air intake characteristics, camming characteristics, etc.) and therefore the map values are set according to the types of individual engines to which the invention is applied.

At the following step S224, a fuel supply correction coefficient KTOTAL and a fuel supply correction variable TTOTAL necessary for estimating the acutal air-fuel ratio are calculated. The coefficient KTOTAL is a product obtained by multiplication of all correction coefficients calcuated based on engine operating parameter signals from various sensors as employed in the previous embodiments (e.g. the engine coolant temperature-dependent correction coefficient KTW, the air-fuel ratio correction coefficient K02 calculated in response to the output from the oxygen concentration sensor, not specifically shown in FIG. 22, the leaning correction coefficient KLS, the atmospheric pressure-dependent correction coefficient KPA, the intake air temperature-dependent correction coefficient KTA, etc.). The variable TTOTAL is the sum of all additive correction terms calculated based on engine operating parameter signals from various sensors (e.g. an after-start-dependent fuel-increasing correction term TAST, an acceleration-dependent correction term TACC, etc).

At the following step S225, the actual controlled air-fuel ratio is estimated (estimated A/F) by the use of the following equation:

$$\text{Estimated } A/F = 14.7 \times Ti/Tout,$$

$$\text{provided that } Tout = Ti \times KTOTAL + TTOTAL,$$

where Ti represents a basic fuel injection amount which is read from a Ti map according to the engine rotational speed NE and the intake pipe absolute pressure PBA. Tout represents a fuel injection amount.

At the following step S226, a KVTREF table is retrieved to read a correction coefficient KVTREF for use in obtaining the reference level VTREF, according to the estimated A/F calculated at the step S225. Then, at a step S227, the basic value VTREF0 of the reference value VTREF obtained at the step S223 is multiplied by the correction coefficient KVTREF obtained at the step S226 to finally determine the referene level VTREF for use in the misfire determination.

Figure 29:
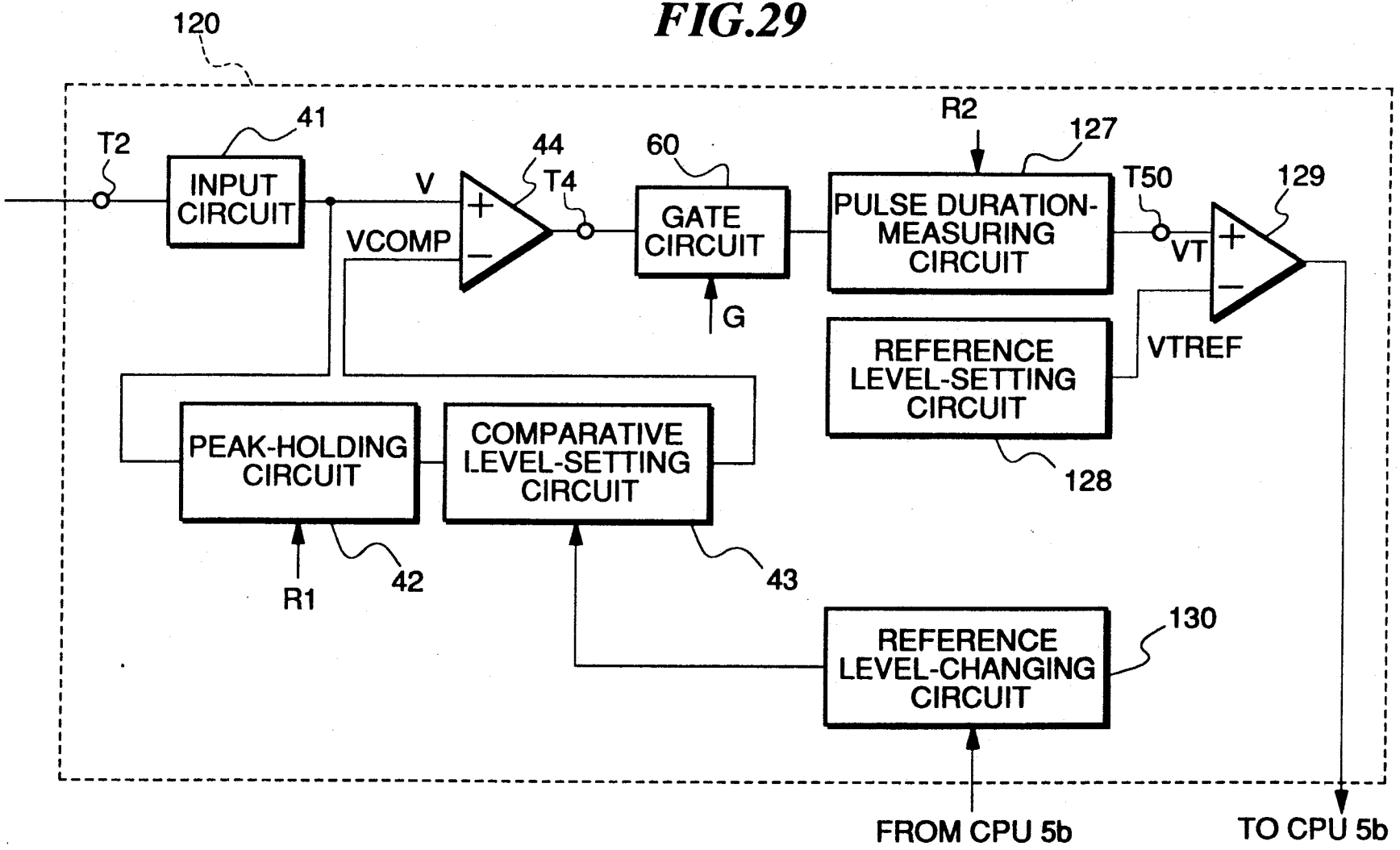
FIG. 29 is a circuit diagram of a misfire-determining circuit according to a variation of the eighth embodiment.

FIG. 29 shows essential parts of a misfire-detecting system according to a variation of the eighth embodiment.

As shown in FIG. 29, this variation is distinguished from the eighth embodiment described above in that instead of directly changing the reference level VTREF by supplying the output from the reference level-changing circuit 130 to the reference level-setting circuit 128, the output from the circuit 130 is supplied to the comparative level-setting circuit 43 to change the comparative level VCOMP. Except for this, the circuit arrangement of the variation is identical with that of the eighth embodiment. More specifically, the FIG. 29 arrangement may be realized by replacing the fixed resistance 432 in the comparative level-setting circuit 43 shown in FIG. 8, by a variable resistance the resistance value of which is variable by means of the reference level-changing circuit 130.

The results of this variation are substantially the same as those obtained by the eighth embodiment.

Although, in the above described eighth embodiment, the actual controlled air-fuel ratio (air-fuel ratio obtained by calculation from the relationship between the corrected air-fuel ratio and the basic air-fuel ratio) is obtained to change the reference value for determining occurrence of a misfire, this is not limitative, but in the case of an internal combustion egnine having a so-called linear output type air-fuel ratio sensor provided in the exhaust system, which has an output characteristic substantially linear to the actual air-fuel ratio, the reference value for determining occurrence of a misfire may be changed according to the air-fuel ratio detected by the linear output type air-fuel ratio sensor.

What is claimed is:

1. In a misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon values of operating parameters of said engine detected by said engine operating condition-detecting means and generating an ignition command signal indicative of the determined ignition timing, and sparking voltage-generating means responsive to said ignition command signal for generating sparking voltage for discharging said at least one spark plug, said misfire-detecting system including:

voltage value-detecting means for detecting a value of said sparking voltage generated by said sparking voltage-generating means after generation of said ignition command signal;

first comparing means for comparing the detected value of said sparking voltage with a first predetermined reference value;

measuring means for measuring a degree to which the detected value of said sparking voltage exceeds said first predetermined reference value;

second camparing means for comparing said degree measured by said measuring means with a second predetermined reference value; and misfire-determining means for determining whether or not a misfire has occurred in said engine, based upon results of said comparison by said second comparing means;

reference value-setting means for setting said second predetermined reference value, based upon detected values of operating parameters of said engine detected by said engine operating condition-detecting means.

2. A misfire-detecting system according to claim 1, wherein said degree to which the detected value of said sparking voltage exceeds said first predetermined reference value is a time period over which the detected value of said sparking voltage exceeds said first predetermined reference value.

3. A misfire-detecting system according to claim 1, wherein said degree to which the detected value of said sparking voltage exceeds said first predetermined reference value is an amount by which the detected value of said sparking voltage exceeds said first predetermined reference value.

4. A misfire-detecting system according to any of claims 1 to 3, wherein said operating parameters of said engine include a rotational speed of said engine, load on said engine, a temperature of intake air drawn into said engine, a temperature of said engine, an air-fuel ratio of an air-fuel mixture supplied to said engine, an exhaust gas recirculation rate, and humidity of the air, said reference value-setting means setting said second predetermined reference value based upon at least one of said operating parameters of said engine.

5. A misfire-detecting system according to claim 4, wherein said reference value-setting means sets a basic value of said second reference value, based upon said rotational speed of said engine and said load on said engine, and corrects said basic value, based upon at least one of said temperature of intake air, said temperature of said engine, said air-fuel ratio, said exhaust gas recirculation rate, and said humidity of the air, to thereby calculate said second predetermined reference value.

6. A misfire-detecting system according to any of claims 1 to 3, including re-charging means for generating a re-charging command signal at a predetermined time after generation of said ignition command signal, and wherein said sparking voltage-generating means applies voltage having a level low enough not to cause discharging of said spark plug to thereby store an electric charge within said sparking voltage-generating means.

7. A misfire-detecting system according to claim 4, including re-charging means for generating a re-charging command signal at a predetermined time after generation of said ignition command signal, and wherein said sparking voltage-generating means applies voltage having a level low enough not to cause discharging of said spark plug to thereby store an electric charge within said sparking voltage-generating means.

8. A misfire-detecting system according to claim 5, including re-charging means for generating a re-charging command signal at a predetermined time after generation of said ignition command signal, and wherein said sparking voltage-generating means applies voltage having a level low enough not to cause discharging of said spark plug to thereby store an electric charge within said sparking voltage-generating means.

9. In a misfire-detecting system for detecting a misfire occurring in an internal combustion engine including at least one spark plug, engine operating condition-detecting means for detecting values of operating parameters of said engine, engine control means for determining a plurality of engine control parameters, based upon values of operating parameters of said engine detected by said engine operating condition-detecting means, for controlling said engine, said engine control means including signal-generating means for determining ignition timing of said engine, based upon values of operating parameters of said engine detected by said engine operating condition-detecting means and generating an ignition command signal indicative of the determined ignition timing, and sparking voltage-generating means responsive to said ignition command signal for generating sparking voltage for discharging said at least one spark plug, said misfire-detecting system including:

voltage value-detecting means for detecting a value of said sparking voltage generated by said sparking voltage-generating means after generation of said ignition command signal;

comparing means for comparing the detected value of said sparking voltage with a predetermined reference value; and misfire-determining means for determining whether or not a misfire has occurred in said engine, based upon results of said comparison by said comparing means;

inhibiting means for inhibiting said determination of occurrence of a misfire by said misfire-determining means, when said engine is in a predetermined operating condition.

10. A misfire-detecting system according to claim 9, wherein said misfire-determining means determines that a misfire has occurred when a degree to which the detected value of said sparking voltage exceeds said predetermined reference value exceeds a second predetermined reference value.

11. A misfire-detecting system according to claim 10, wherein said degree to which the detected value of said sparking voltage exceeds said predetermined reference value is a time period over which the detected value of said sparking voltage exceeds said predetermined reference value.

12. A misfire-detecting system according to claim 10, wherein said degree to which the detected value of said sparking voltage exceeds said predetermined reference value is an amount by which the detected value of said sparking voltage exceeds said predetermined reference value.

13. A misfire-detecting system according to claim 9, including referende value-setting means for setting said predetermined reference value, based upon values of at least part of said operating parameters of said engine.

14. A misfire-detecting system according to any of claims 9 to 13, wherein said operating parameters of said engine include a rotational speed of said engine, load on said engine, a temperature of said engine, a temperature of intake air drawn into said engine, and a voltage of a battery for supplying power to said engine control means, said predetermined operating condition of said engine being a condition in which at least one of first, second and third conditions is satisfied, said first condition being satisfied when at least one of said rotational speed of said engine, said load on said engine, said temperature of said engine, said temperature of intake air drawn into said engine, and said voltage of said battery falls outside a respective predetermined range, said second condition being satisfied when excessive slip control of driving wheels of a vehicle on which said engine is installed is being carried out, or when air-fuel ratio leaning control is being carried out, or when fuel supply to said engine is being interrupted, and said third condition being satisfied when a predetermined time period has not elapsed after termination of said interruption of fuel supply to said engine.

15. A misfire-detecting system according to any of claims 9 to 13, wherein said engine control means has changeable basic output characteristic for determining said engine control parameters, said predetermined operating condition of said engine is a condition in which at least one of said basic output characteristics has been changed.

16. A misfire-detecting system according to claim 15, wherein said predetermined operating condition of said engine is a condition in which at least one of exhaust gas recirculation control and air-fuel ratio feedback control has been started or terminated.

17. A misfire-detecting system according to claim 15, wherein said predetermined condition of said engine is a condition in which at least one of a valve-operating characteristic of intake valves of said engine and a valve-operating characteristic of exhaust valves of said engine has been changed.

18. A misfire-detecting system according to any of claims 9 to 13, wherein said predetermined operating condition of said engine is a condition in which at least one of said operating parameters of said engine and said engine control parameters assumes an abnormal value.

19. A misfire-detecting system according to any of claims 9 to 13, wherein said predetermined operating condition of said engine is a condition in which said engine is being started.

20. A misfire-detecting system according to any of claims 9 to 13, wherein said predetermined operating condition of said engine is a condition in which a predetermined time period has not elapsed after said engine was started.

21. A misfire-detecting system according to claim 20, wherein said predetermined time period is set depending on said temperature of said engine.

* * * * *